US012390847B2

(12) United States Patent
Saika et al.

(10) Patent No.: US 12,390,847 B2
(45) Date of Patent: Aug. 19, 2025

(54) MOLDING DEVICE AND METAL PIPE

(71) Applicant: SUMITOMO HEAVY INDUSTRIES, LTD., Tokyo (JP)

(72) Inventors: Masayuki Saika, Niihama (JP); Norieda Ueno, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 184 days.

(21) Appl. No.: 18/329,610

(22) Filed: Jun. 6, 2023

(65) Prior Publication Data

US 2023/0311188 A1 Oct. 5, 2023

Related U.S. Application Data

(63) Continuation of application No. PCT/JP2022/001126, filed on Jan. 14, 2022.

(30) Foreign Application Priority Data

Feb. 9, 2021 (JP) ..... 2021-019159

(51) Int. Cl.

| | |
|---|---|
| ***B21D 26/047*** | (2011.01) |
| ***B21D 19/08*** | (2006.01) |
| ***B21D 26/033*** | (2011.01) |
| ***B21D 26/039*** | (2011.01) |
| ***B21D 26/041*** | (2011.01) |
| ***B21D 37/16*** | (2006.01) |

(52) U.S. Cl.

CPC ..... *B21D 26/047* (2013.01)

(58) Field of Classification Search

CPC .. B21D 26/047; B21D 26/033; B21D 26/039; B21D 26/41; B21D 19/08; B21D 37/16

See application file for complete search history.

(56) References Cited

U.S. PATENT DOCUMENTS

| | | | | |
|---|---|---|---|---|
| 10,773,292 | B2 | 9/2020 | Saika et al. | |
| 10,926,313 | B2 | 2/2021 | Ishizuka et al. | |
| 2016/0279693 | A1* | 9/2016 | Ueno | B21D 26/035 |
| 2018/0161843 | A1* | 6/2018 | Saika | B21D 26/045 |

FOREIGN PATENT DOCUMENTS

| | | |
|---|---|---|
| CA | 3 101 330 A1 | 2/2020 |
| EP | 4 116 005 A1 | 1/2023 |
| JP | H6-226339 A | 8/1994 |

(Continued)

OTHER PUBLICATIONS

English translate (KR20150075673A), retrieved date Mar. 3, 2025.*

(Continued)

*Primary Examiner* — Mohammed S. Alawadi

(74) *Attorney, Agent, or Firm* — WTA Patents

(57) ABSTRACT

A forming device forms a metal pipe with a flange and includes a forming tool that forms the metal pipe, in which the forming tool includes a first die and a second die facing each other in a first direction in a cross-sectional view, and a third die disposed on at least one side of a metal pipe material in a second direction intersecting the first direction, and at least one of the first die and the second die is divided in the second direction and sandwiches a part of the metal pipe material in the second direction to form a flange portion.

10 Claims, 23 Drawing Sheets

(56) References Cited

FOREIGN PATENT DOCUMENTS

| | | | | | |
|---|---|---|---|---|---|
| JP | 2009-220141 | A | | 10/2009 | |
| JP | 2016-221556 | A | | 12/2016 | |
| JP | 2019171428 | A | * | 10/2019 | ..... G05B 19/4182 |
| KR | 10-2015-0075673 | A | | 7/2015 | |
| KR | 20150075673 | A | * | 7/2015 | |
| WO | WO 2017/034025 | A1 | | 3/2017 | |

OTHER PUBLICATIONS

English translate (JP2019171428A), retrieved date Mar. 3, 2025.*
European Search Report of EP Application No. 22752520.1 Mailed on Jun. 12, 2024.
International Search Report of PCT/JP2022/001126, mailed on Apr. 5, 2022.

* cited by examiner

MOLDING DEVICE AND METAL PIPE

CROSS-REFERENCE TO RELATED APPLICATIONS

This application is a bypass continuation of International PCT Application No. PCT/JP2022/001126, filed on Jan. 14, 2021, which claims priority to Japanese Patent Application No. 2021-019159, filed on Feb. 9, 2021, which are incorporated by reference herein in their entirety.

BACKGROUND

Technical Field

A certain embodiment of the present invention relates to a forming device and a metal pipe.

Description of Related Art

In the related art, a forming device used for forming a metal pipe is known. For example, the related art discloses a forming device that includes a forming tool including a lower die and an upper die paired with each other, and a fluid supply unit for supplying a fluid into a metal pipe material held between the upper and lower dies.

SUMMARY

A forming device according to an aspect of the present invention is a forming device that forms a metal pipe with a flange and includes a forming tool that forms the metal pipe, in which the forming tool includes a first die and a second die facing each other in a first direction in a cross-sectional view, and a third die disposed on at least one side of a metal pipe material in a second direction intersecting the first direction, and at least one of the first die and the second die is divided in the second direction and sandwiches a part of the metal pipe material in the second direction to form a flange portion.

A metal pipe according to an embodiment of the present invention includes a hollow pipe portion that extends in a longitudinal direction in a cross-sectional view, and a flange portion that protrudes from the pipe portion to at least one side in a transverse direction perpendicular to the longitudinal direction.

In this metal pipe, the flange portion of the pipe portion that protrudes in the transverse direction from a wall portion extending in the longitudinal direction in a cross-sectional view can be formed. Therefore, the strength and the rigidity of the metal pipe can be improved for a load in the longitudinal direction.

DETAILED DESCRIPTION

Figure 1:
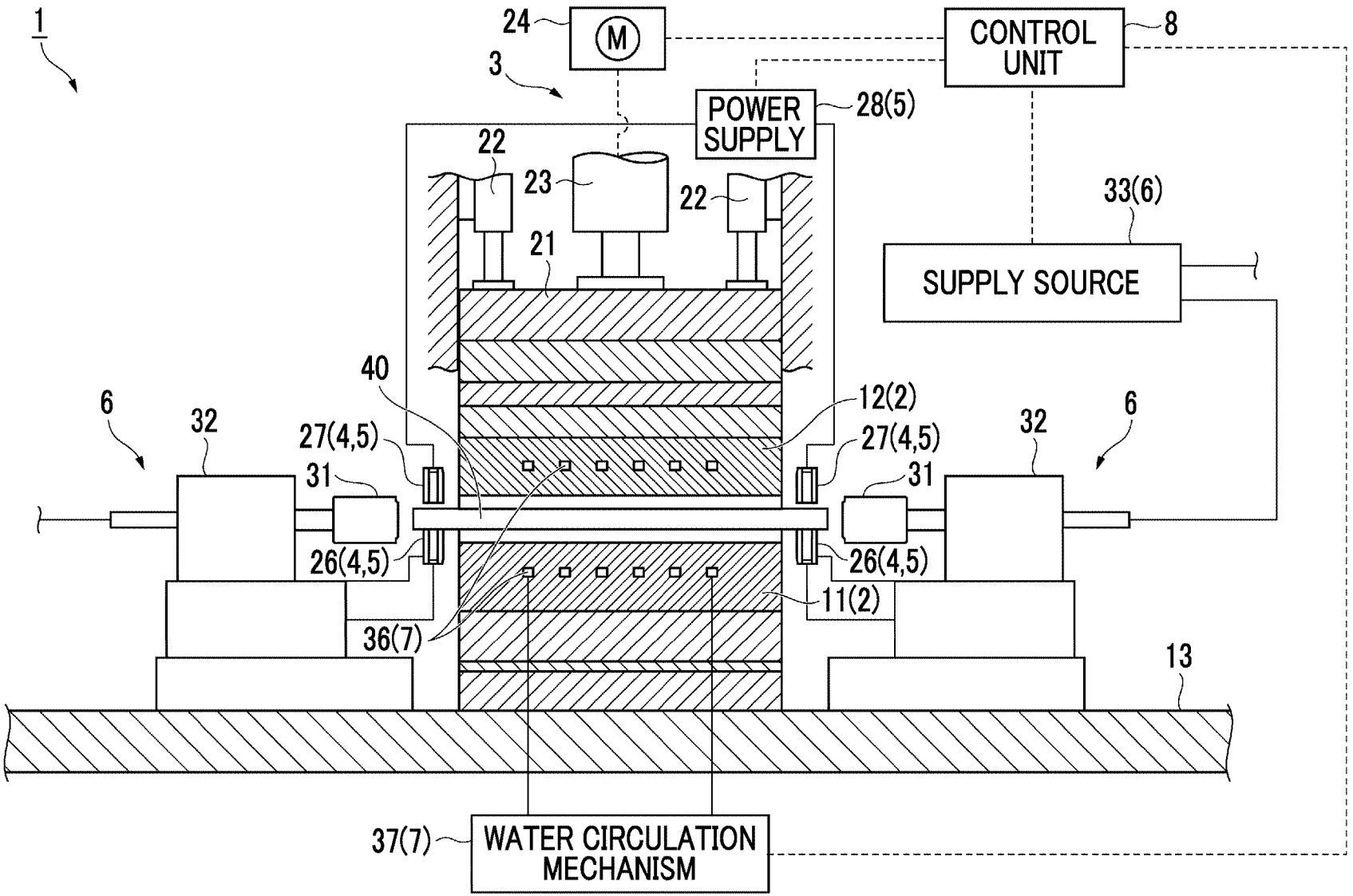
FIG. 1 is a schematic view of a forming device according to an embodiment of the present invention.

In the forming device such as the related art described above, there is a case where the metal pipe with a flange is formed by crushing both sides of the metal pipe material in a lateral direction with the upper die and the lower die. In such a forming device, there is a need for further improving a strength and a rigidity of the metal pipe with a flange.

According to an embodiment of the present invention, it is possible to provide a forming device capable of improving the strength and the rigidity of a metal pipe with a flange and a metal pipe capable of improving the strength and the rigidity.

In the forming device, a forming tool includes a first die and a second die facing each other in a first direction in a cross-sectional view, and a third die disposed on at least one side of a metal pipe material in a second direction intersecting the first direction. The first die and the second die can form a shape of a pipe portion in the first direction of a metal pipe. In addition, the third die can form a shape of the pipe portion in the second direction of the metal pipe. Here, at least one of the first die and the second die is divided in the second direction and sandwiches a part of the metal pipe material in the second direction to form a flange portion. Therefore, it is possible to form the flange portion that protrudes in the first direction which is a direction in which the first die and the second die face each other. Accordingly, it is possible to form the flange portion that can secure a strength and a rigidity in accordance with a direction of a load acting on the metal pipe during use. As described above, the strength and the rigidity of the metal pipe with a flange can be improved.

At least one of the first die and the second die may include a first portion and a second portion that sandwich a part of the metal pipe material in the second direction to form the flange portion. Accordingly, it is possible to form the flange portion that protrudes in the first direction which is a direction in which the first die and the second die face each other.

Both the first die and the second die may have the first portion and the second portion. Accordingly, it is possible to form the flange portions on both sides in the first direction with respect to the pipe portion to improve the strength and the rigidity of the metal pipe.

The first portion and the second portion in the first die, and the first portion and the second portion in the second die may form the flange portions at positions different from each other in the second direction. In this case, it is possible to adjust positions where the strength and the rigidity are increased with the flange portions in the second direction on one side and the other side in the first direction of the pipe portion. In addition, it is also possible to control a deformation behavior of the metal pipe depending on a direction of a load applied to the metal pipe.

The first portion and the second portion may form the flange portion at the same position as one side surface in the second direction of the metal pipe. In this case, it is also possible to control a deformation behavior of the metal pipe depending on a direction of a load applied to the metal pipe in a case where there is a shape limitation such that a position of the flange portion is only at an end in terms of position.

At least one of the first die and the second die may include a third portion that sandwiches another part of the metal pipe material with the second portion to form another flange portion. In this case, the number of the flange portions can be increased to increase the strength and the rigidity.

The first portion and the second portion may form the flange portion inclined with respect to the first direction. In this case, the rigidity can be increased, and a deformation behavior of a formed body depending on a direction of a load applied to the metal pipe can be controlled in a more preferable direction.

The metal pipe may include a pair of the flange portions protruding from the pipe portion to both sides in the transverse direction. Accordingly, the strength and the rigidity of the metal pipe can be improved.

The pair of flange portions may be formed at positions different from each other in the longitudinal direction. In this case, it is possible to adjust positions where the strength and the rigidity are increased with the flange portions in the longitudinal direction on one side and the other side in the transverse direction of the pipe portion.

The flange portion may be formed at the same position as one side surface in the longitudinal direction of the pipe portion. In this case, the same stress is generated for a load from a target direction (a load such as a bending load), and the shape can be balanced in terms of strength.

A plurality of the flange portions protruding to at least one side in the transverse direction may be formed in the pipe portion at positions different from each other in the longitudinal direction. In this case, the number of the flange portions can be increased to increase the strength and the rigidity.

The flange portion may be inclined with respect to the transverse direction. In this case, even if the rigidity and the strength are inferior to those in a case where the flange portions are in the vertical direction, there is a case where it is more convenient to have a certain inclination angle in joining with ancillary parts, and it is possible to meet design requirements. In addition, there is a possibility that the deformation behavior can be optimized depending on the direction of the load and the inclination of the flange portion.

Hereinafter, a preferred embodiment of the present invention will be described with reference to the drawings. In addition, in the respective drawings, the same portions or corresponding portions are designated by the same reference signs, and duplicated descriptions will not be repeated.

FIG. 1 is a schematic view of a forming device 1 according to the present embodiment. As shown in FIG. 1, the forming device 1 is a device that forms a metal pipe having a hollow shape by blow forming. In the present embodiment, the forming device 1 is installed on a horizontal plane. The forming device 1 includes a forming tool 2 (forming die), a drive mechanism 3, a holding unit 4, a heating unit 5, a fluid supply unit 6, a cooling unit 7, and a control unit 8. In addition, in the present specification, the metal pipe refers to a hollow article after completion of forming in the forming device 1, and a metal pipe material 40 refers to a hollow article before completion of forming in the forming device 1. The metal pipe material 40 is a steel-type pipe material that can be hardened. In addition, in a horizontal direction, a direction in which the metal pipe material 40 extends during forming is sometimes referred to as an "extending direction", and a direction perpendicular to the extending direction is sometimes referred to as a "lateral direction (second direction)".

The forming tool 2 is a die for forming the metal pipe material 40 into the metal pipe and includes a lower die 11 (first die) and an upper die 12 (second die) facing each other in a vertical direction (first direction). In addition, the forming tool 2 includes a pair of lateral dies 14A and 14B (third dies) facing each other in the lateral direction (refer to FIG. 4). Detailed shapes and the like of the dies 11, 12, 14A, and 14B will be described later. The lower die 11 and the upper die 12 are made of steel blocks. The lower die 11 is fixed to a base stage 13 via a die holder or the like. The upper die 12 is fixed to a slide of the drive mechanism 3 via a die holder or the like.

The drive mechanism 3 is a mechanism that moves at least one of the lower die 11 and the upper die 12. In FIG. 1, the drive mechanism 3 has a configuration in which only the upper die 12 is moved. The drive mechanism 3 includes a slide 21 that moves the upper die 12 such that the lower die 11 and the upper die 12 are joined together, and a pull-back cylinder 22 serving as an actuator that generates a force for pulling the slide 21 upward, a main cylinder 23 serving as a drive source that downward-pressurizes the slide 21, and a drive source 24 that applies a driving force to the main cylinder 23.

The holding unit 4 is a mechanism that holds the metal pipe material 40 disposed between the lower die 11 and the upper die 12. The holding unit 4 includes a lower electrode 26 and an upper electrode 27 that hold the metal pipe material 40 on one end side in the extending direction of the forming tool 2, and a lower electrode 26 and an upper electrode 27 that hold the metal pipe material 40 on the other end side in the extending direction of the forming tool 2. The lower electrodes 26 and the upper electrodes 27 on both sides in the extending direction hold the metal pipe material 40 by sandwiching vicinities of the end portions of the metal pipe material 40 from the vertical direction. In addition, groove portions having a shape corresponding to an outer peripheral surface of the metal pipe material 40 are formed on an upper surface of the lower electrode 26 and a lower surface of the upper electrode 27. The lower electrode 26 and the upper electrode 27 are provided with drive mechanisms (not shown) and are movable independently in the vertical direction.

The heating unit 5 heats the metal pipe material 40. The heating unit 5 is a mechanism that heats the metal pipe material 40 by energizing the metal pipe material 40. The heating unit 5 heats the metal pipe material 40 in a state in which the metal pipe material 40 is spaced apart from the lower die 11 and the upper die 12 between the lower die 11 and the upper die 12. The heating unit 5 includes the lower electrodes 26 and the upper electrodes 27 on both sides in the extending direction described above, and a power supply 28 that causes a current to flow through the metal pipe material via the electrodes 26 and 27. In addition, the heating unit 5 may be disposed in a preceding process of the forming device 1 and may perform heating externally.

The fluid supply unit 6 is a mechanism that supplies a high-pressure fluid into the metal pipe material 40 held between the lower die 11 and the upper die 12. The fluid supply unit 6 supplies the high-pressure fluid into the metal pipe material 40 that has been brought into a high-temperature state by being heated by the heating unit 5 and expands the metal pipe material 40. The fluid supply unit 6 is provided on both end sides of the forming tool 2 in the extending direction. The fluid supply unit 6 includes a nozzle 31 that supplies a fluid from an opening portion of an end portion of the metal pipe material 40 to the inside of the metal pipe material 40, a drive mechanism 32 that moves the nozzle 31 forward and backward with respect to the opening portion of the metal pipe material 40, and a supply source 33 that supplies the high-pressure fluid into the metal pipe material 40 via the nozzle 31. The drive mechanism 32 brings the nozzle 31 into close contact with the end portion of the metal pipe material 40 in a state in which a sealing property is secured at the time of supply and exhaust of the fluid (refer to FIGS. 2A and 2B) and at other times, separates the nozzle 31 from the end portion of the metal pipe material 40. In addition, the fluid supply unit 6 may supply a gas such as high-pressure air or an inert gas as the fluid. Additionally, the fluid supply unit 6 may include the heating unit 5 together with the holding unit 4 having a mechanism that moves the metal pipe material 40 in the vertical direction as the same device.

Figure 2A:
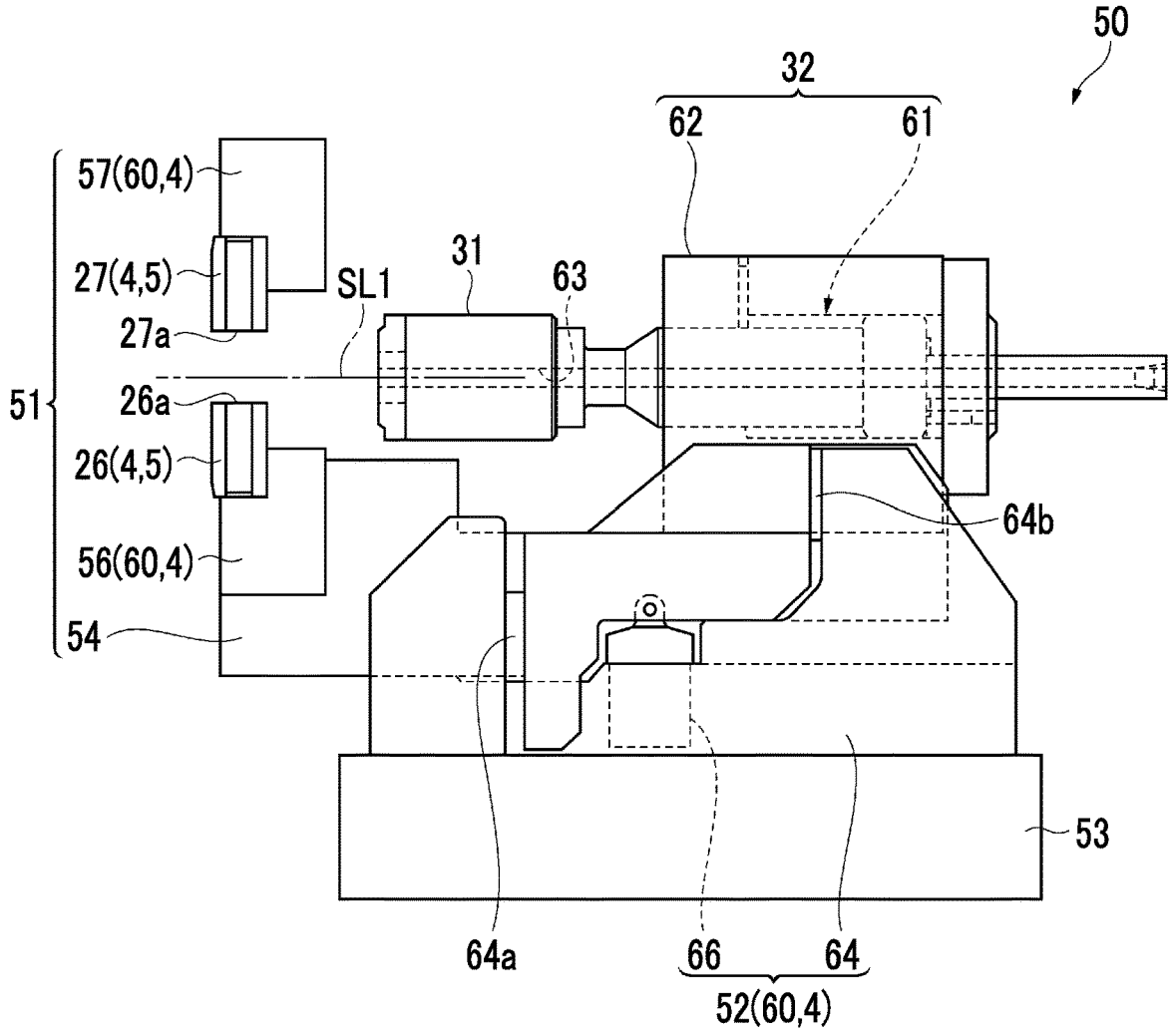
FIGS. 2A and 2B are cross-sectional views showing a state when a nozzle has sealed a metal pipe material.
Figure 2B:
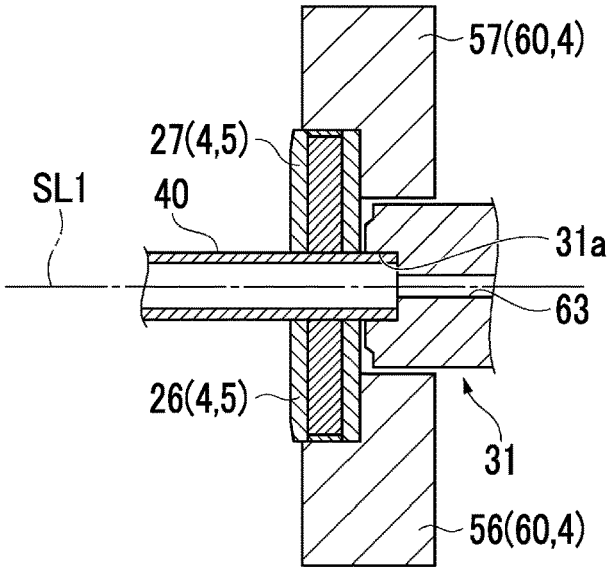

FIG. 2A is a schematic side view showing a heating and expanding unit 50 in which components of the holding unit 4, the heating unit 5, and the fluid supply unit 6 are unitized. FIG. 2B is a cross-sectional view showing a state when the nozzle 31 has sealed the metal pipe material 40.

As shown in FIG. 2A, the heating and expanding unit 50 includes the above-described lower electrode 26 and upper electrode 27, an electrode mounting unit 51 on which the electrodes 26 and 27 are mounted, the above-described nozzle 31 and drive mechanism 32, an elevating unit 52, and a unit base 53. The electrode mounting unit 51 includes an elevating frame 54 and electrode frames 56 and 57. The electrode frames 56 and 57 function as a part of a drive mechanism 60 that supports and moves each of the electrodes 26 and 27. The drive mechanism 32 drives the nozzle 31 and lifts and lowers the nozzle 31 together with the electrode mounting unit 51. The drive mechanism 32 includes a piston 61 that holds the nozzle 31, and a cylinder 62 that drives the piston. The elevating unit 52 includes an elevating frame base 64 attached to an upper surface of the unit base 53, and an elevating actuator 66 that applies an elevating operation to the elevating frame 54 of the electrode mounting unit 51 by the elevating frame base 64. The elevating frame base 64 includes guide portions 64*a* and 64*b* that guide the elevating operation of the elevating frame 54 with respect to the unit base 53. The elevating unit 52 functions as a part of the drive mechanism 60 of the holding unit 4. The heating and expanding unit 50 includes a plurality of the unit bases 53 of which upper surfaces have different inclination angles, and is allowed to collectively change and adjust inclination angles of the lower electrode 26 and the upper electrode 27, the nozzle 31, the electrode mounting unit 51, the drive mechanism 32, and the elevating unit 52 by replacing the unit bases 53.

The nozzle 31 is a cylindrical member into which the end portion of the metal pipe material 40 can be inserted. The nozzle 31 is supported by the drive mechanism 32 such that a center line of the nozzle 31 coincides with a reference line SL1. An inner diameter of a supply port 31*a* at an end portion of the nozzle 31 on the side of the metal pipe material 40 substantially coincides with an outer diameter of the metal pipe material 40 after expansion forming. In this state, the nozzle 31 supplies the high-pressure fluid from an internal flow path 63 to the metal pipe material 40. Examples of the high-pressure fluid include a gas and the like.

Returning to FIG. 1, the cooling unit 7 is a mechanism for cooling the forming tool 2. By cooling the forming tool 2, the cooling unit 7 can rapidly cool the metal pipe material 40 when the expanded metal pipe material 40 has come into contact with a forming surface of the forming tool 2. The cooling unit 7 includes a flow path 36 formed inside the lower die 11 and the upper die 12, and a water circulation mechanism 37 that supplies cooling water to the flow path 36 and circulates the cooling water.

The control unit 8 is a device that controls the entire forming device 1. The control unit 8 controls the drive mechanism 3, the holding unit 4, the heating unit 5, the fluid supply unit 6, and the cooling unit 7. The control unit 8 repeatedly performs an operation of forming the metal pipe material 40 with the forming tool 2.

Specifically, the control unit 8 controls, for example, a transport timing from a transport device such as a robot arm to dispose the metal pipe material 40 between the lower die 11 and the upper die 12 in an open state. Alternatively, the control unit 8 may wait for a worker to manually dispose the metal pipe material 40 between the lower die 11 and the upper die 12. Additionally, the control unit 8 controls an actuator of the holding unit 4 and the like such that the metal pipe material 40 is supported by the lower electrodes 26 on both sides in the extending direction, and then the upper electrodes 27 are lowered to sandwich the metal pipe material 40. Additionally, the control unit 8 controls the heating unit 5 to energize and heat the metal pipe material 40. Accordingly, an axial current flows through the metal pipe material 40, and an electric resistance of the metal pipe material 40 itself causes the metal pipe material 40 itself to generate heat due to Joule heat.

The control unit 8 controls the drive mechanism 3 to lower the upper die 12 and bring the upper die 12 close to the lower die 11 to close the forming tool 2. On the other hand, the control unit 8 controls the fluid supply unit 6 to seal the opening portions of both ends of the metal pipe material 40 with the nozzle 31 and supply the fluid. Accordingly, the metal pipe material 40 softened by heating expands and comes into contact with the forming surface of the forming tool 2. Then, the metal pipe material 40 is formed so as to follow a shape of the forming surface of the forming tool 2. When the metal pipe material 40 comes into contact with the forming surface, quenching of the metal pipe material 40 is performed by being rapidly cooled with the forming tool 2 cooled by the cooling unit 7.

Figure 3:
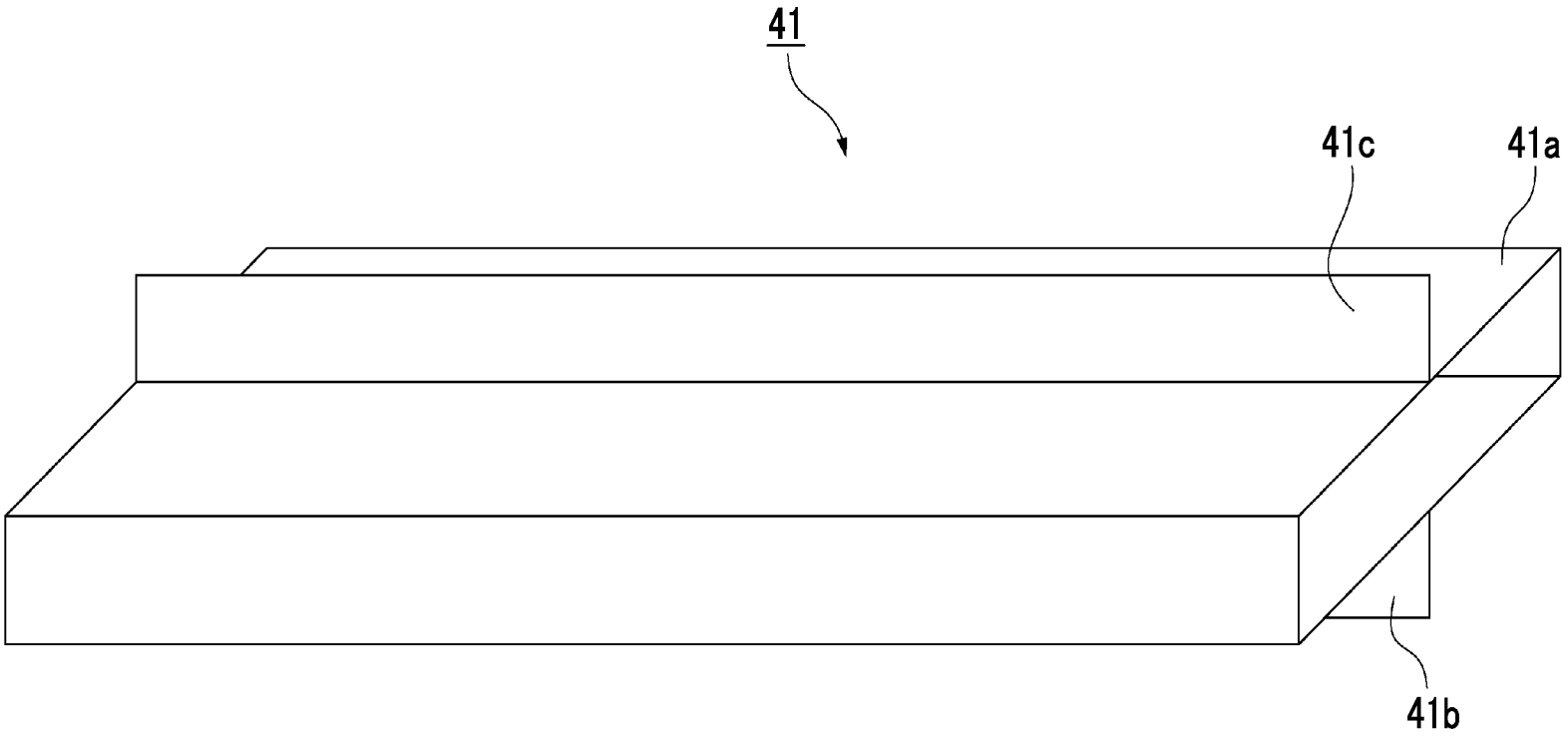
FIG. 3 is a schematic perspective view of a metal pipe.

A metal pipe 41 formed by the forming device 1 will be described with reference to FIG. 3. The metal pipe 41 includes a hollow pipe portion 41*a* and flange portions 41*b* and 41*c*. In a cross-sectional view (a state shown in FIG. 7), the pipe portion 41*a* has a rectangular shape extending in a longitudinal direction and a transverse direction. The flange portions 41*b* and 41*c* are formed by crushing both end portions of the metal pipe material 40. In the following description, locations that are planned to become the flange portions 41*b* and 41*c* after completion in the metal pipe material 40 are referred to as flange portions 40*b* and 40*c* (refer to FIGS. 5 and 6).

Figure 4:
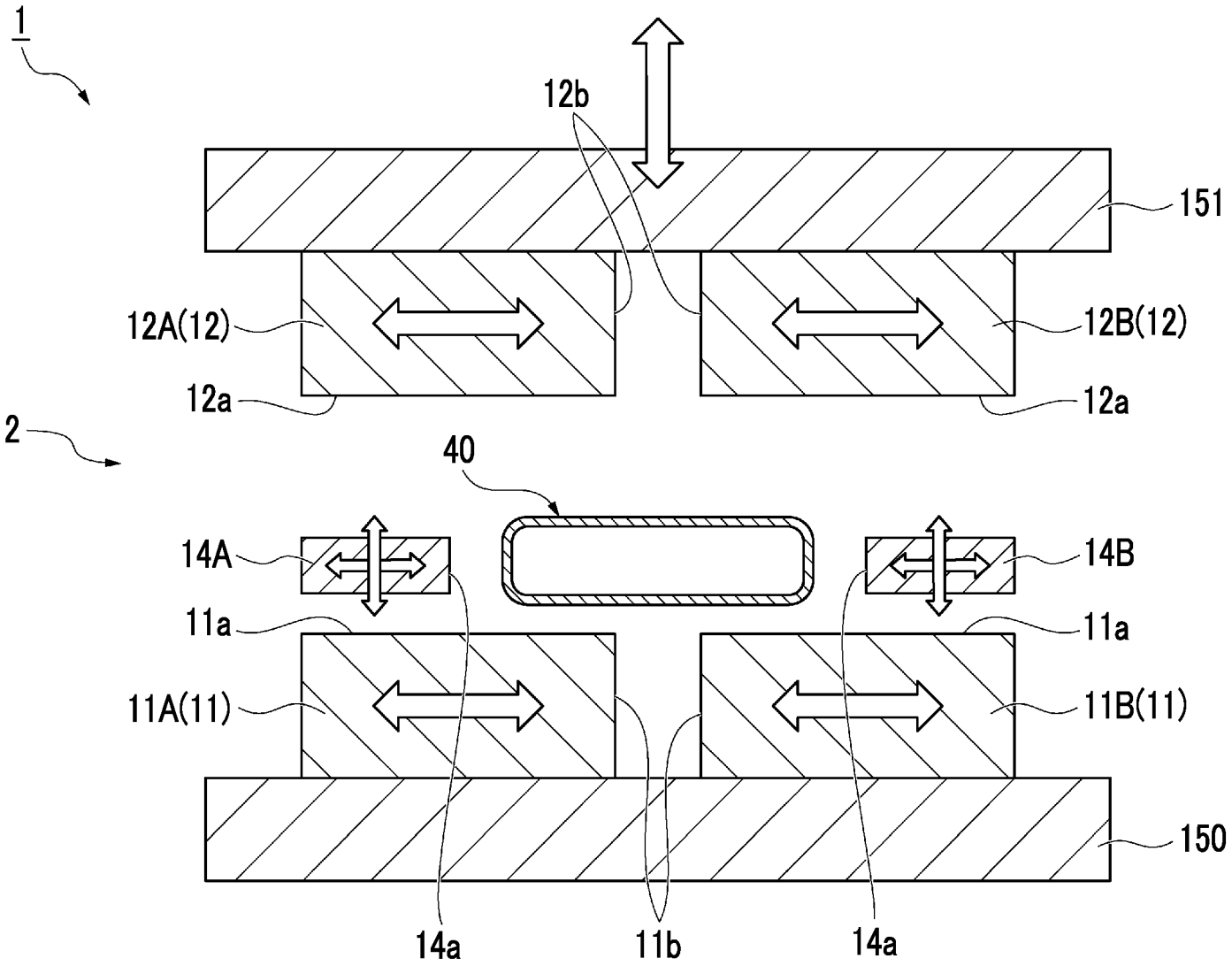
FIG. 4 is a cross-sectional view showing a state of forming by a forming tool.

In the present embodiment, as shown in FIG. 4, the metal pipe material 40 has a rectangular shape in a cross-sectional view. The metal pipe material 40 is disposed with respect to the forming tool 2 such that the longitudinal direction thereof is parallel to the lateral direction of the forming device 1 and the transverse direction thereof is parallel to the vertical direction of the forming device 1 in a cross-sectional view. Therefore, the metal pipe 41 immediately after completion is also disposed with respect to the forming tool 2 such that the longitudinal direction thereof is parallel to the lateral direction of the forming device 1 and the transverse direction thereof is parallel to the vertical direction of the forming device 1 (refer to FIG. 7). In the following description, in a case where terms "upper", "lower", and "lateral" are used for the metal pipe 41 and the metal pipe material 40, a posture when the metal pipe 41 and the metal pipe material 40 are disposed in the forming tool 2 is assumed to be a reference.

Next, a configuration of the forming tool 2 will be described in detail with reference to FIG. 4. The lower die 11 is fixed to a base member 150 provided on the base stage 13 (refer to FIG. 1). The lower die 11 includes a first portion 11A and a second portion 11B that are divided in the lateral direction and form a flange portion 41*b* by sandwiching a part of a lower wall portion of the metal pipe material 40 in the lateral direction. The first portion 11A and the second portion 11B each include a pipe portion forming surface 11*a* that extends parallel to the lateral direction at an upper end portion and a flange portion forming surface 11*b* that extends parallel to the vertical direction on an inner side in the lateral direction. The pipe portion forming surface 11*a* is a forming surface for forming a lower wall portion of the metal pipe 41. The flange portion forming surface 11*b* is a forming surface for forming the flange portion 41*b* on a lower side of the metal pipe 41. The first portion 11A and the second portion 11B can reciprocate in the lateral direction.

The upper die 12 is fixed to a base member 151 provided on the slide 21 (refer to FIG. 1). The upper die 12 includes a first portion 12A and a second portion 12B that are divided in the lateral direction and form a flange portion 41*c* by sandwiching a part of an upper wall portion of the metal pipe material 40 in the lateral direction. The first portion 12A and the second portion 12B include a pipe portion forming surface 12*a* that extends parallel to the lateral direction at a lower end portion and a flange portion forming surface 12*b* that extends parallel to the vertical direction on an inner side in the lateral direction. The pipe portion forming surface 12*a* is a forming surface for forming an upper wall portion of the metal pipe 41. The flange portion forming surface 12*b* is a forming surface for forming the flange portion 41*c* on an upper side of the metal pipe 41. The first portion 12A and the second portion 12B can reciprocate in the lateral direction. In addition, the first portion 12A and the second portion 12B can reciprocate in the vertical direction as the base member 151 reciprocates in the vertical direction together with the slide 21 (refer to FIG. 1).

The die 14A on a lateral side is disposed on one side of the metal pipe material 40 in the lateral direction. The die 14B on a lateral side is disposed on the other side of the metal pipe material 40 in the lateral direction. The die 14A is disposed between the pipe portion forming surface 11*a* of the first portion 11A and the pipe portion forming surface 12*a* of the first portion 12A in the vertical direction. The die 14B is disposed between the pipe portion forming surface 11*a* of the second portion 11B and the pipe portion forming surface 12*a* of the second portion 12B in the vertical direction. The dies 14A and 14B each have a pipe portion forming surface 14*a* that extends parallel to the vertical direction on an inner side in the lateral direction. The dies 14A and 14B can reciprocate in the lateral direction and reciprocate in the vertical direction. Lower surfaces of the dies 14A and 14B come into surface contact with the pipe portion forming surface 11*a* of the lower die 11. Upper surfaces of the dies 14A and 14B come into surface contact with the pipe portion forming surface 12*a* of the upper die 12.

The lateral movements of the respective portions 11A, 11B, 12A, and 12B and the dies 14A and 14B are performed simultaneously or at different timings. The lateral movements of the respective portions 11A, 11B, 12A, and 12B and the dies 14A and 14B may be performed by individually providing a drive source for each member. Alternatively, a wedge mechanism may be provided such that the respective portions 11A, 11B, 12A, and 12B and the dies 14A and 14B are closed in the lateral direction as the slide 21 lowers the upper die 12. In this case, a spring mechanism may be provided such that the respective portions 11A, 11B, 12A, and 12B and the dies 14A and 14B open in the lateral direction when the slide 21 raises the upper die 12.

Next, a procedure for forming with the forming tool 2 will be described. First, as shown in FIG. 4, the metal pipe material 40 is set in an internal space of the forming tool 2. As shown in FIG. 4, in an initial forming state, the respective dies 11, 12, 14A, and 14B are disposed at positions separated from the metal pipe material 40. The control unit 8 lowers the upper die 12 from the state shown in FIG. 4 to a position separated from the metal pipe material 40, and heats the metal pipe material 40 in this state.

Figure 5:
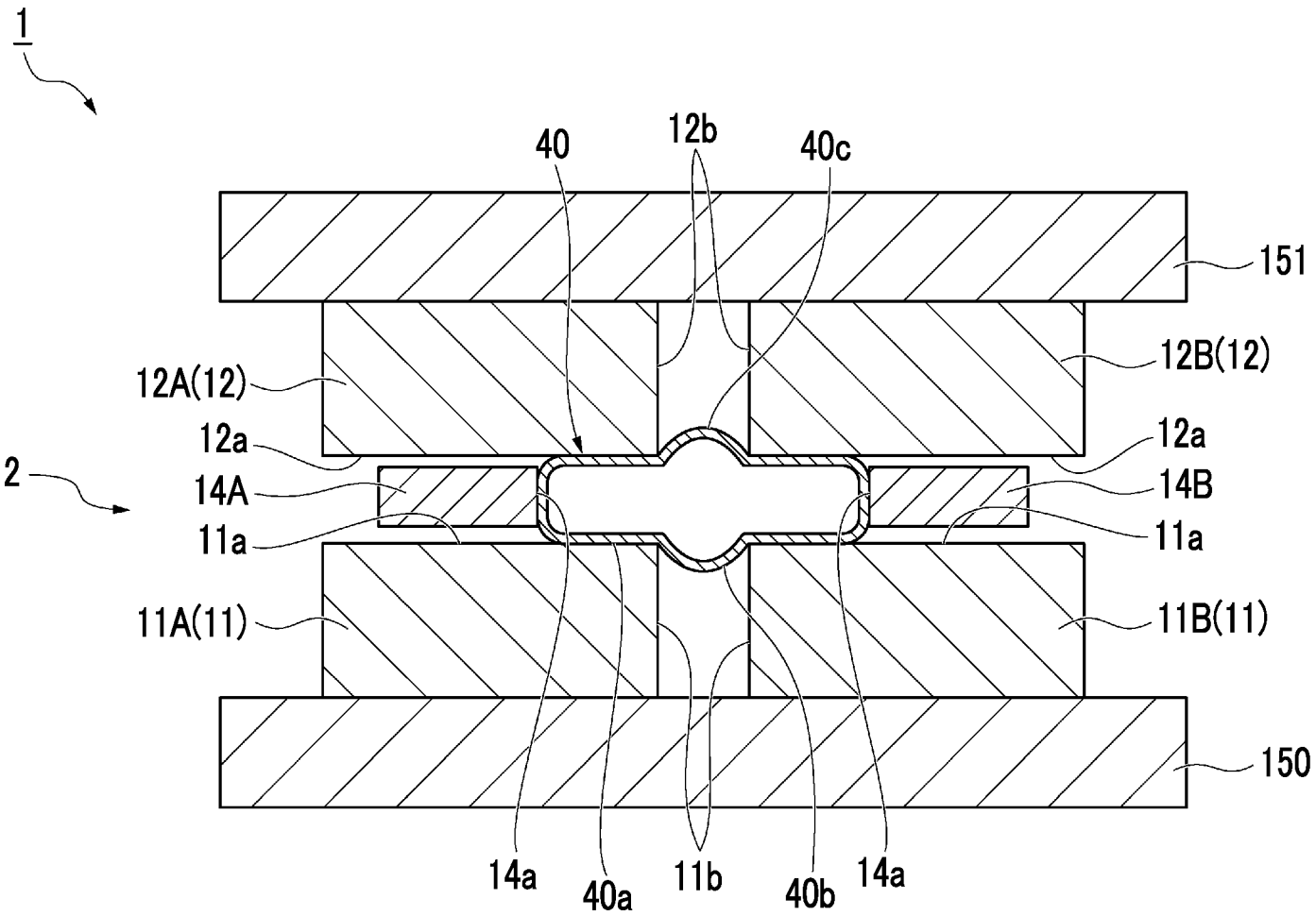
FIG. 5 is a cross-sectional view showing a state of forming by the forming tool.

Next, as shown in FIG. 5, the control unit 8 lowers the die 12, the dies 14A and 14B, and the metal pipe material 40 downward. In this case, the pipe portion forming surface 12*a* of the die 12 comes into contact with the upper wall portion of the metal pipe material 40, the pipe portion forming surface 11*a* of the die 11 comes into contact with the lower wall portion of the metal pipe material 40, and the pipe portion forming surfaces 14*a* of the dies 14A and 14B come into contact with side wall portions of the metal pipe material 40. In addition, the control unit 8 controls the fluid supply unit 6 to supply the fluid into the metal pipe material 40 to perform blow forming (primary blowing). The portions of the flange portions 40*b* and 40*c* of the metal pipe material 40 on both sides in the vertical direction expand so as to enter between a pair of the flange portion forming surfaces 11*b* of the die 11 and enter between a pair of the flange portion forming surfaces 12*b* of the die 12. In this case, the side wall portions on both sides of the metal pipe material 40 come into contact with the pipe portion forming surfaces 14*a* of the dies 14A and 14B, so that further outward deformation in the lateral direction is restricted.

Figure 6:
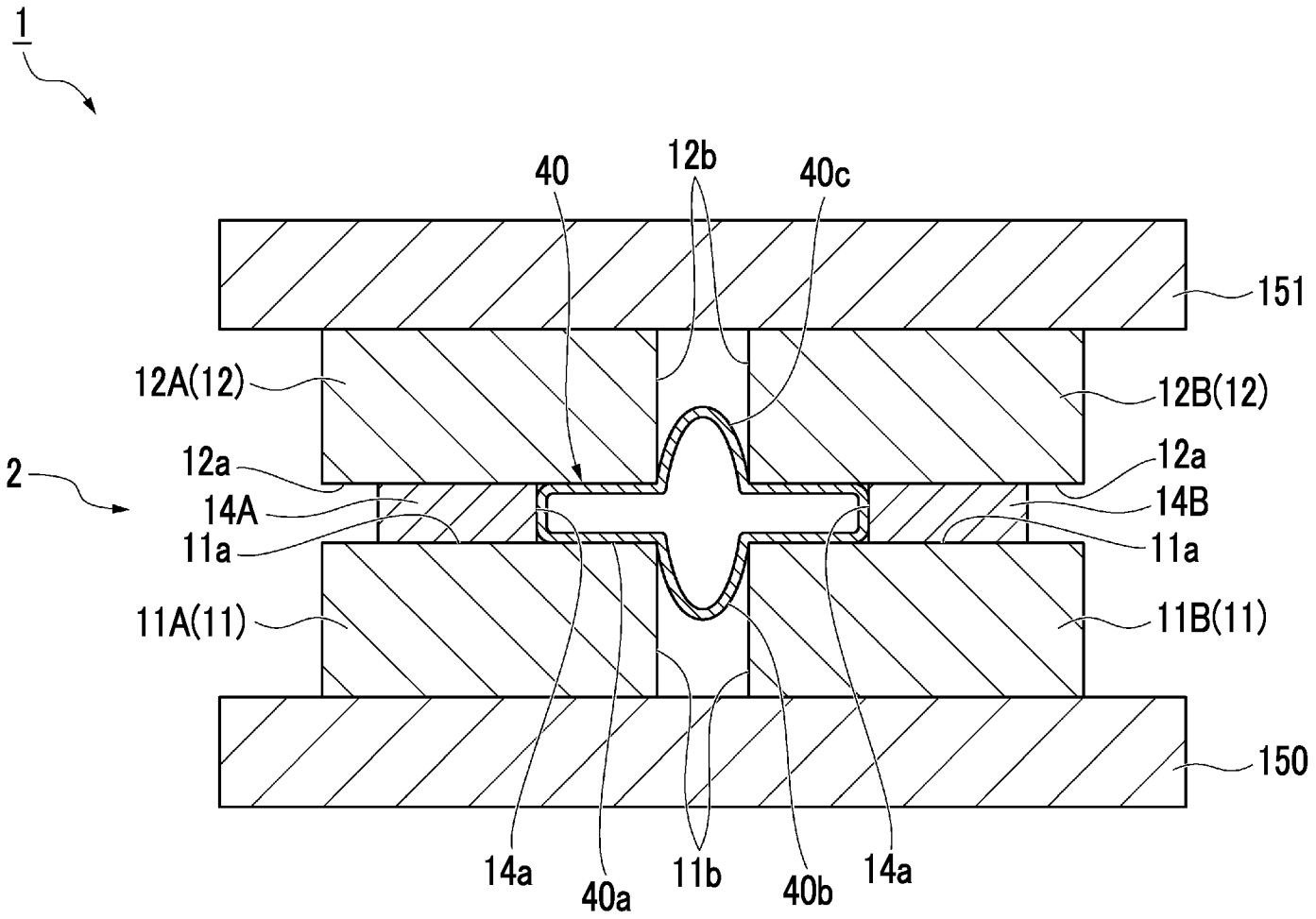
FIG. 6 is a cross-sectional view showing a state of forming by the forming tool.

Next, as shown in FIG. 6, the control unit 8 further lowers the die 12 and the dies 14A and 14B downward. Accordingly, the portions 11A and 11B of the die 11 come into contact with the dies 14A and 14B in the vertical direction, and the portions 12A and 12B of the die 12 come into contact with the dies 14A and 14B in the vertical direction.

Figure 7:
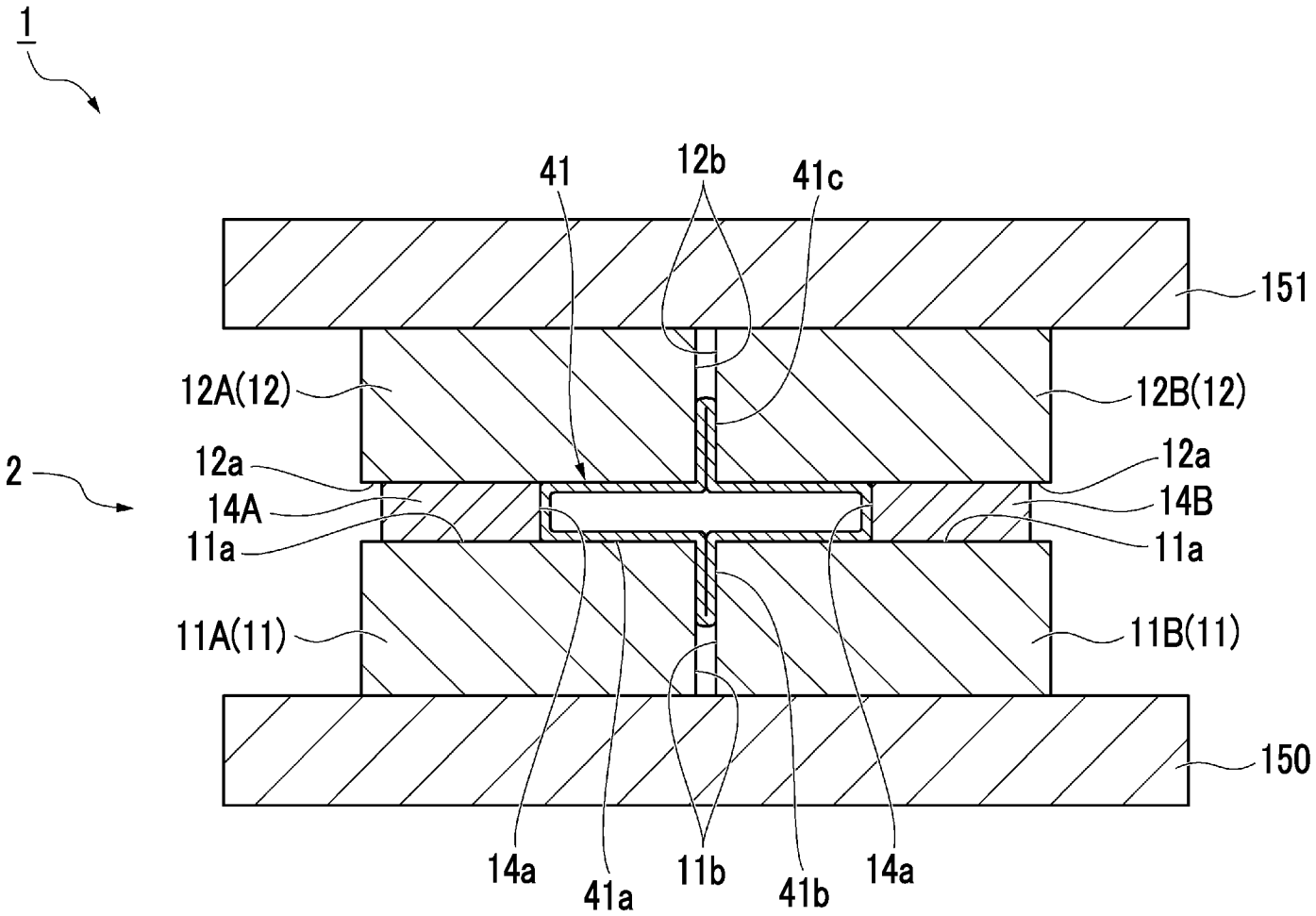
FIG. 7 is a cross-sectional view showing a state of forming by the forming tool.
Figure 8:
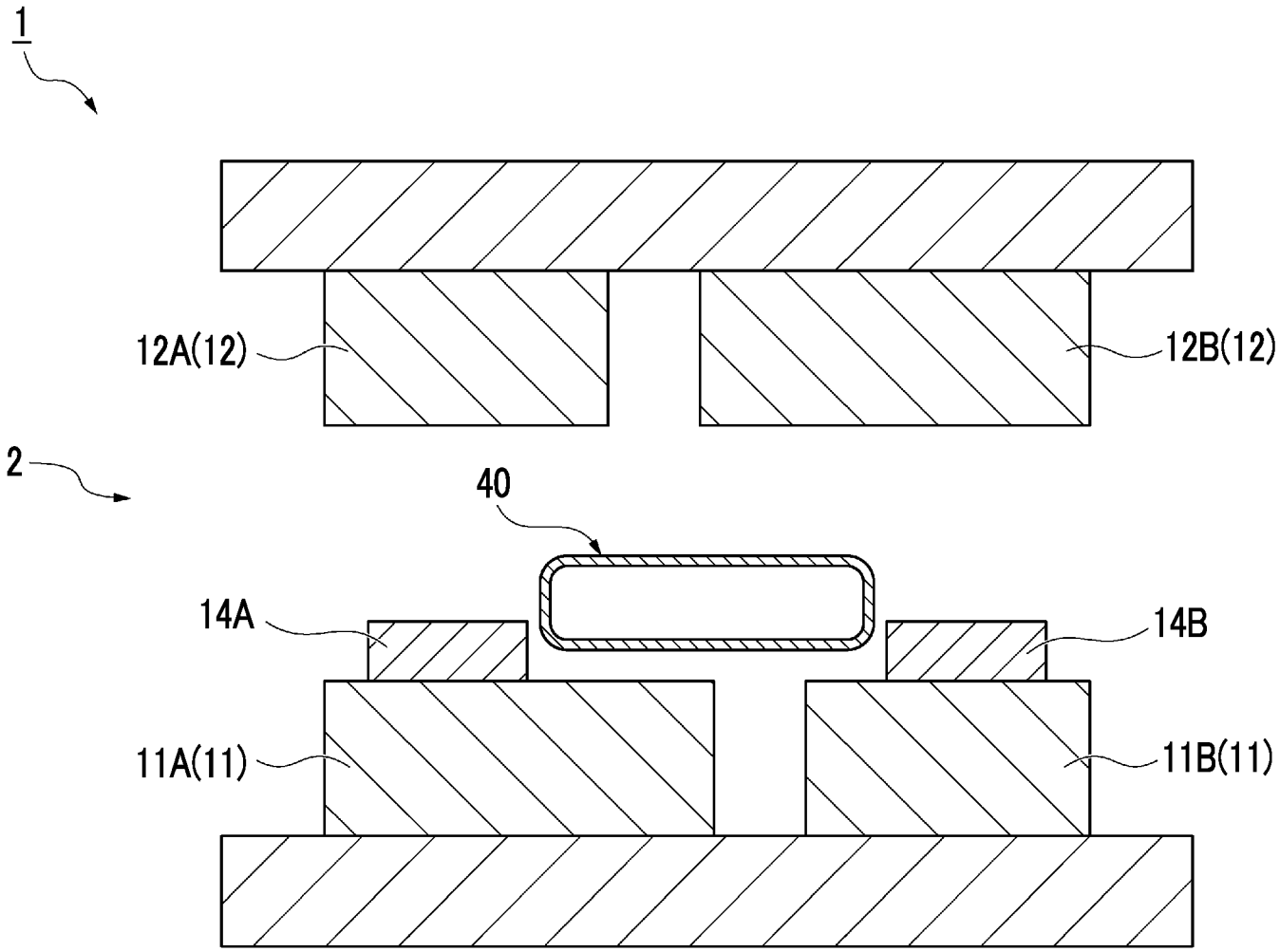
FIG. 8 is a cross-sectional view showing a state of forming by the forming tool.
Figure 9:
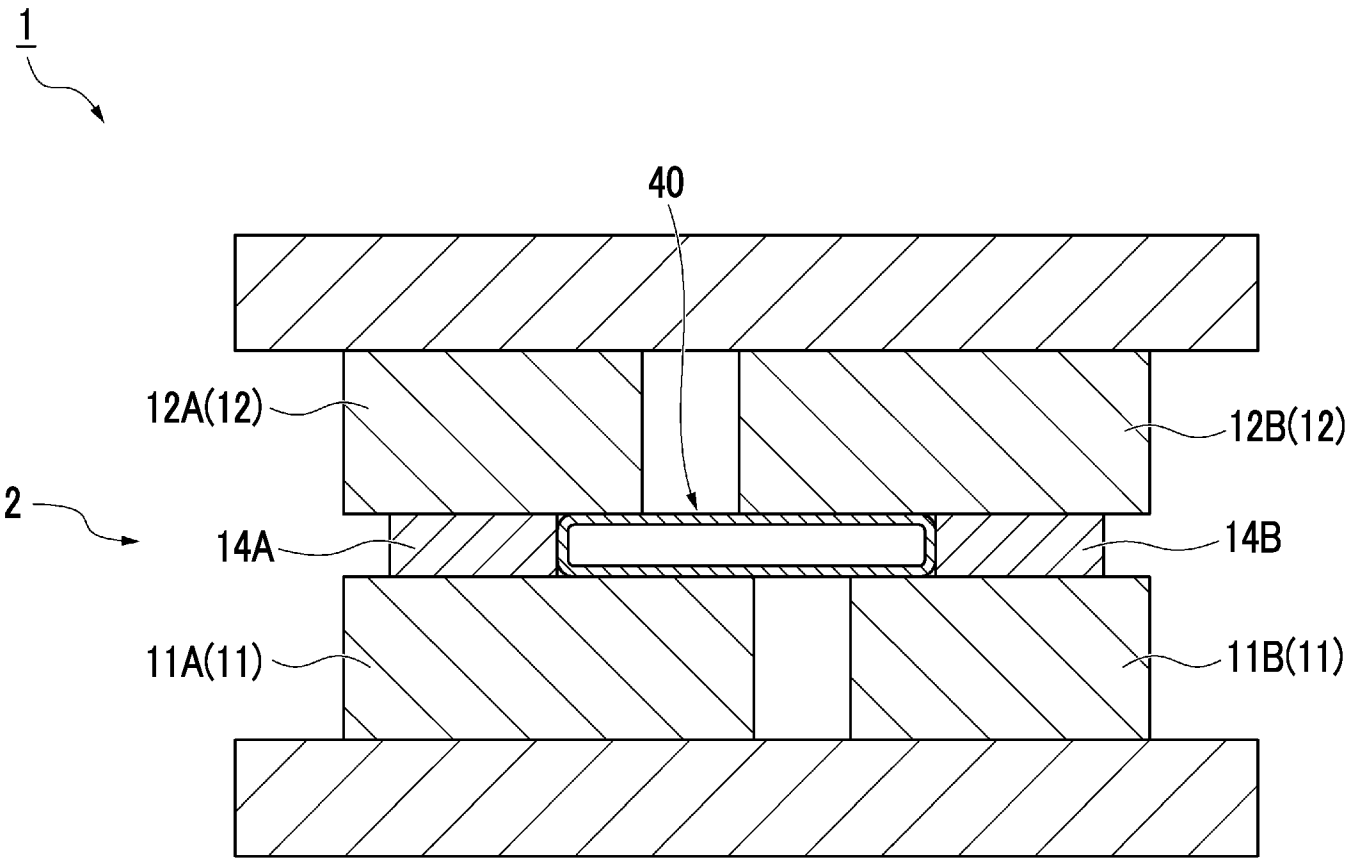
FIG. 9 is a cross-sectional view showing a state of forming by the forming tool.
Figure 10:
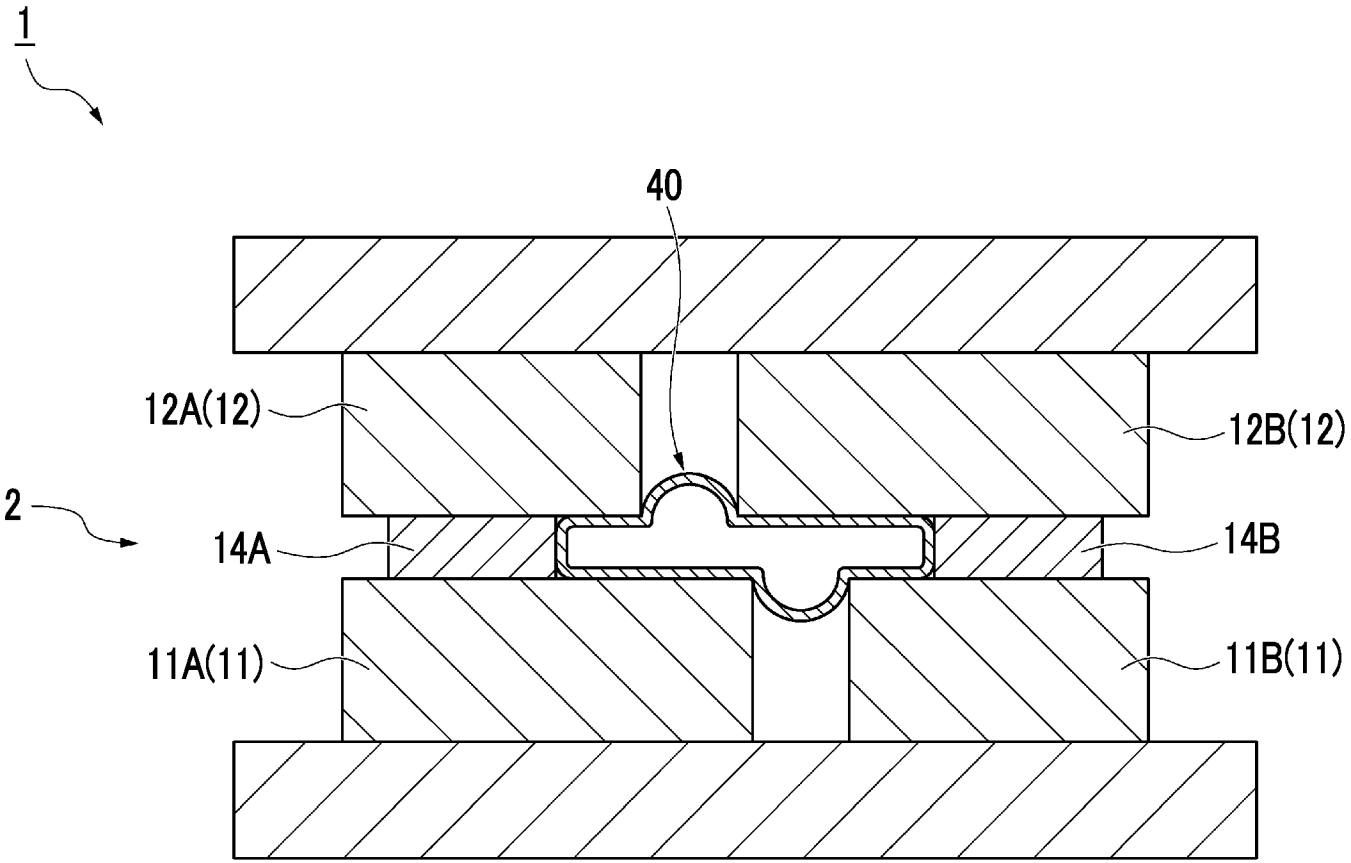
FIG. 10 is a cross-sectional view showing a state of forming by the forming tool.

Next, as shown in FIG. 7, the control unit 8 moves the portions 11A and 11B inward in the lateral direction and moves the portions 12A and 12B inward in the lateral direction. Accordingly, the flange portion forming surfaces 11*b* of the portions 11A and 11B sandwich and crush the flange portion 40*b* of the metal pipe material 40. The flange portion forming surfaces 12*b* of the portions 12A and 12B sandwich and crush the flange portion 40*c* of the metal pipe material 40. Accordingly, the flange portions 41*b* and 41*c* of the metal pipe 41 are formed. In addition, the control unit 8 controls the fluid supply unit 6 to supply the fluid into the pipe portion 40*a* of the metal pipe material 40 to perform blow forming (secondary blowing). Accordingly, the pipe portion 41*a* of the metal pipe 41 is formed. As described above, the metal pipe 41 is completed.

Next, operations and effects of the forming device 1 according to the present embodiment will be described.

In the forming device 1, the forming tool 2 includes the lower die 11 and the upper die 12 facing each other in the vertical direction and includes the dies 14A and 14B disposed on both sides of the metal pipe material 40 in the lateral direction intersecting the vertical direction in a cross-sectional view. The die 11 and the die 12 can form a shape of the pipe portion 41*a* in the vertical direction of the metal pipe 41. In addition, the dies 14A and 14B can form a shape of the pipe portion 41*a* in the lateral direction of the metal pipe 41. Here, the die 11 and the die 12 include the first portions 11A and 12A and the second portions 11B and 12B that are divided in the lateral direction and form the flange portions 41*b* and 41*c* by sandwiching a part of the metal pipe material 40 in the lateral direction. Therefore, it is possible to form the flange portions 41*b* and 41*c* that protrude in the vertical direction which is a direction in which the die 11 and the die 12 face each other. Accordingly, it is possible to form the flange portions 41*b* and 41*c* which can secure a strength and a rigidity in accordance with a direction of a load acting on the metal pipe 41 during use. As described above, the strength and the rigidity of the metal pipe 41 with a flange can be improved.

Specifically, the metal pipe 41 according to the present embodiment includes the hollow pipe portion 41*a* that extends in the longitudinal direction and the flange portion 41*b* and 41*c* that protrude from the pipe portion 41*a* to both sides in the transverse direction perpendicular to the longitudinal direction in a cross-sectional view.

In the metal pipe 41, the flange portions 41*b* and 41*c* of the pipe portion 41*a* that protrude in the transverse direction from a wall portion (wall portion forming a long side) extending in the longitudinal direction in a cross-sectional view can be formed. Since the metal pipe 41 is sometimes used in a vehicle frame, there is a possibility that a load acts on the long side of the metal pipe 41. When there is no flange portion on the long side, the metal pipe is easily deformed. However, by forming the flange portion, it is possible to improve the strength and the rigidity without being easily deformed. In addition, since the flange portion is formed along the longitudinal direction, the strength and the rigidity of the metal pipe 41 can be improved for a load in the longitudinal direction.

Both the lower die 11 and the upper die 12 may include the first portions 11A and 12A and the second portions 11B and 12B. Accordingly, the flange portions 41*b* and 41*c* can be formed on both sides in the vertical direction with respect to the pipe portion 41*a* to improve the strength and the rigidity of the metal pipe 41.

The metal pipe 41 may include a pair of the flange portions 41*b* and 41*c* protruding from the pipe portion 41*a* to both sides in the transverse direction. Accordingly, the strength and the rigidity of the metal pipe 41 can be improved.

The present invention is not limited to the above-described embodiment.

Figure 11:
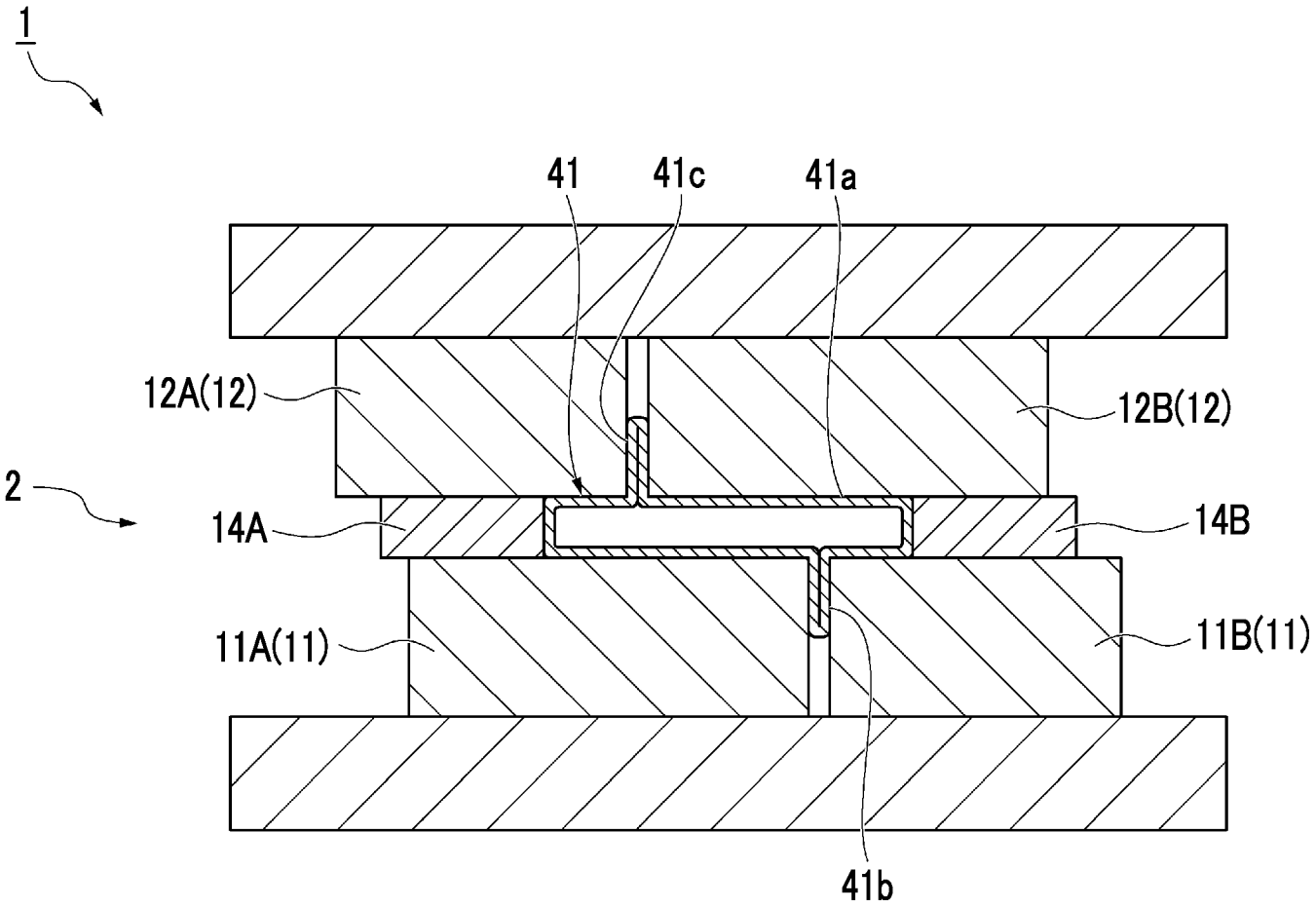
FIG. 11 is a cross-sectional view showing a state of forming by the forming tool.
Figure 12:
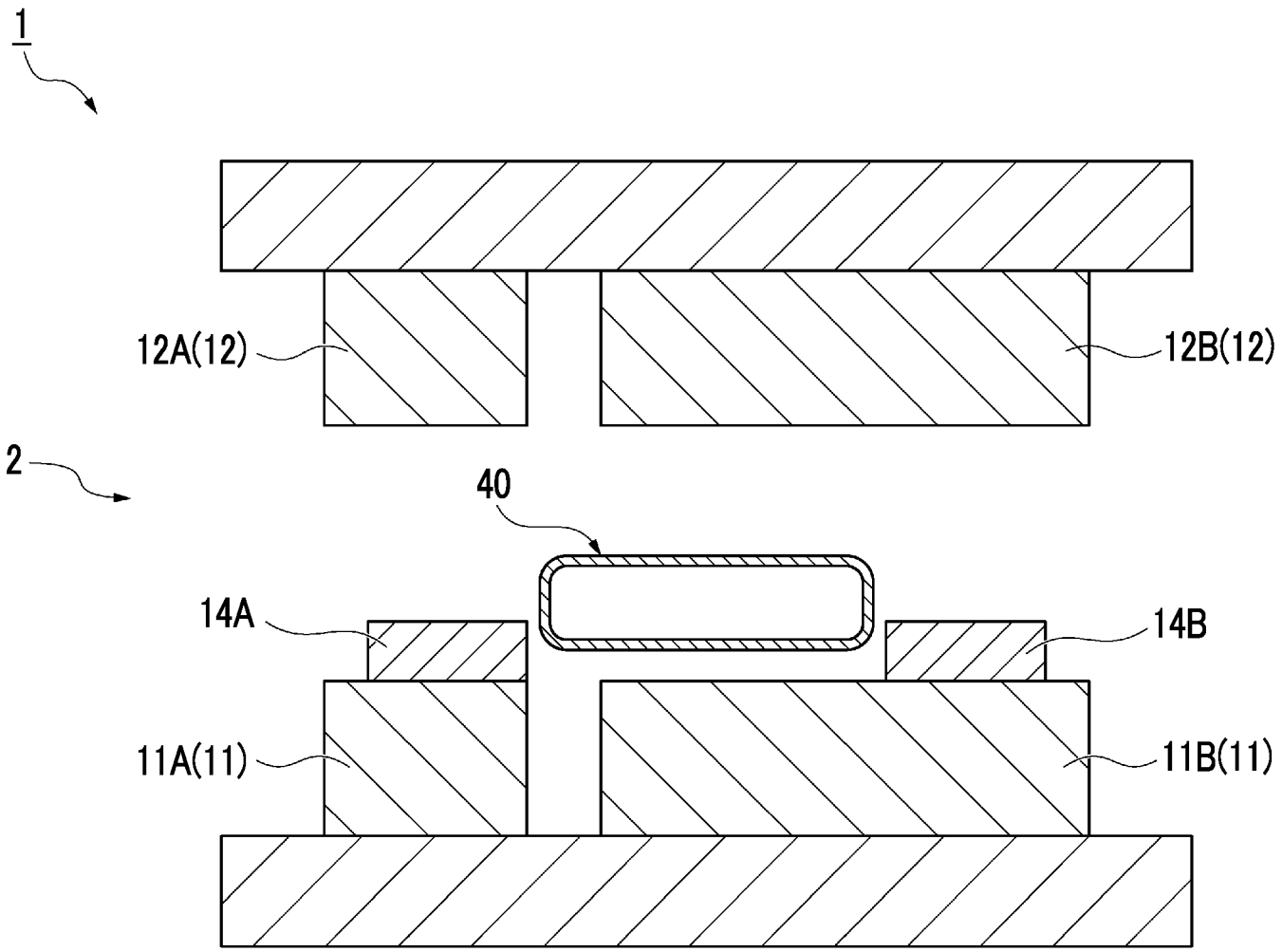
FIG. 12 is a cross-sectional view showing a state of forming by the forming tool.
Figure 13:
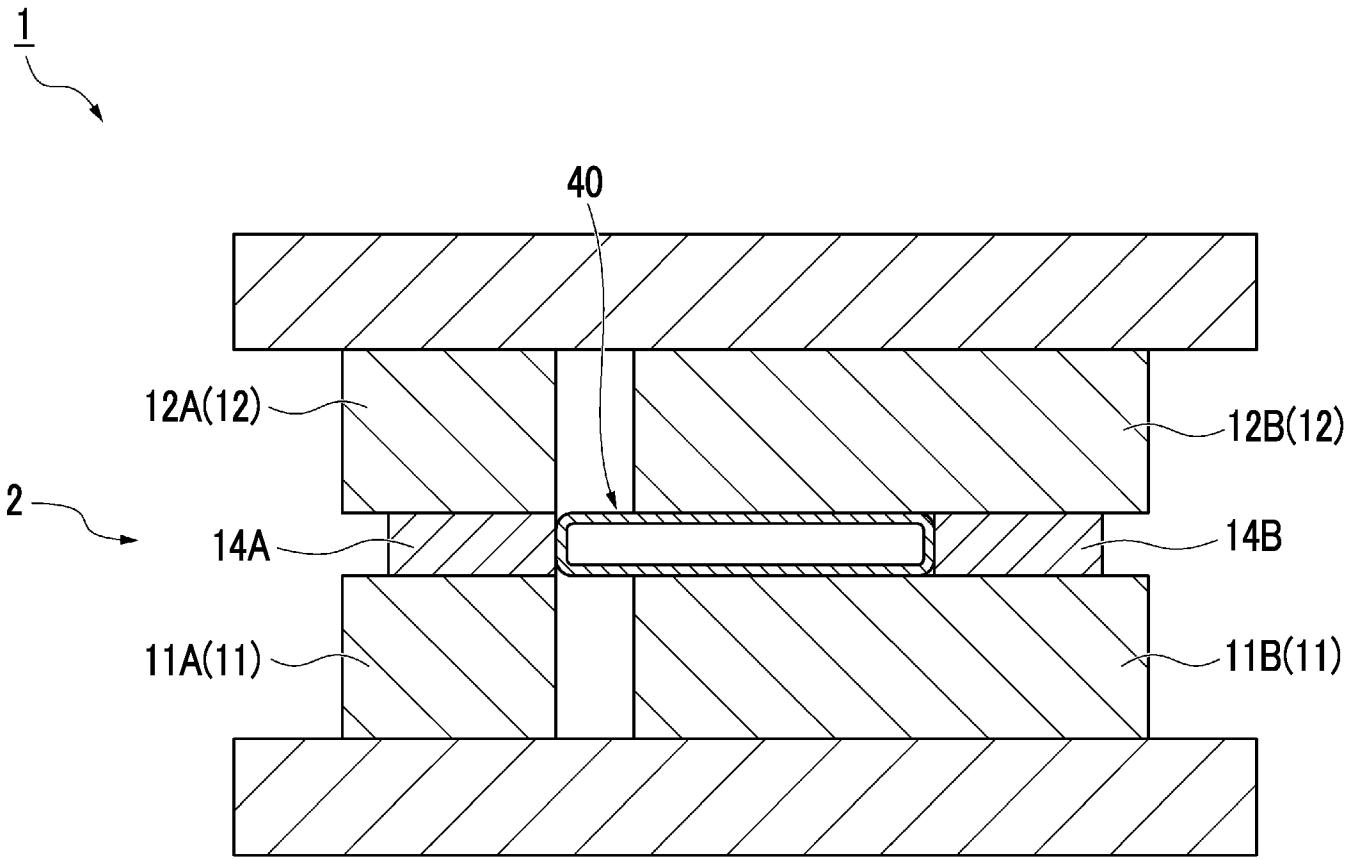
FIG. 13 is a cross-sectional view showing a state of forming by the forming tool.
Figure 14:
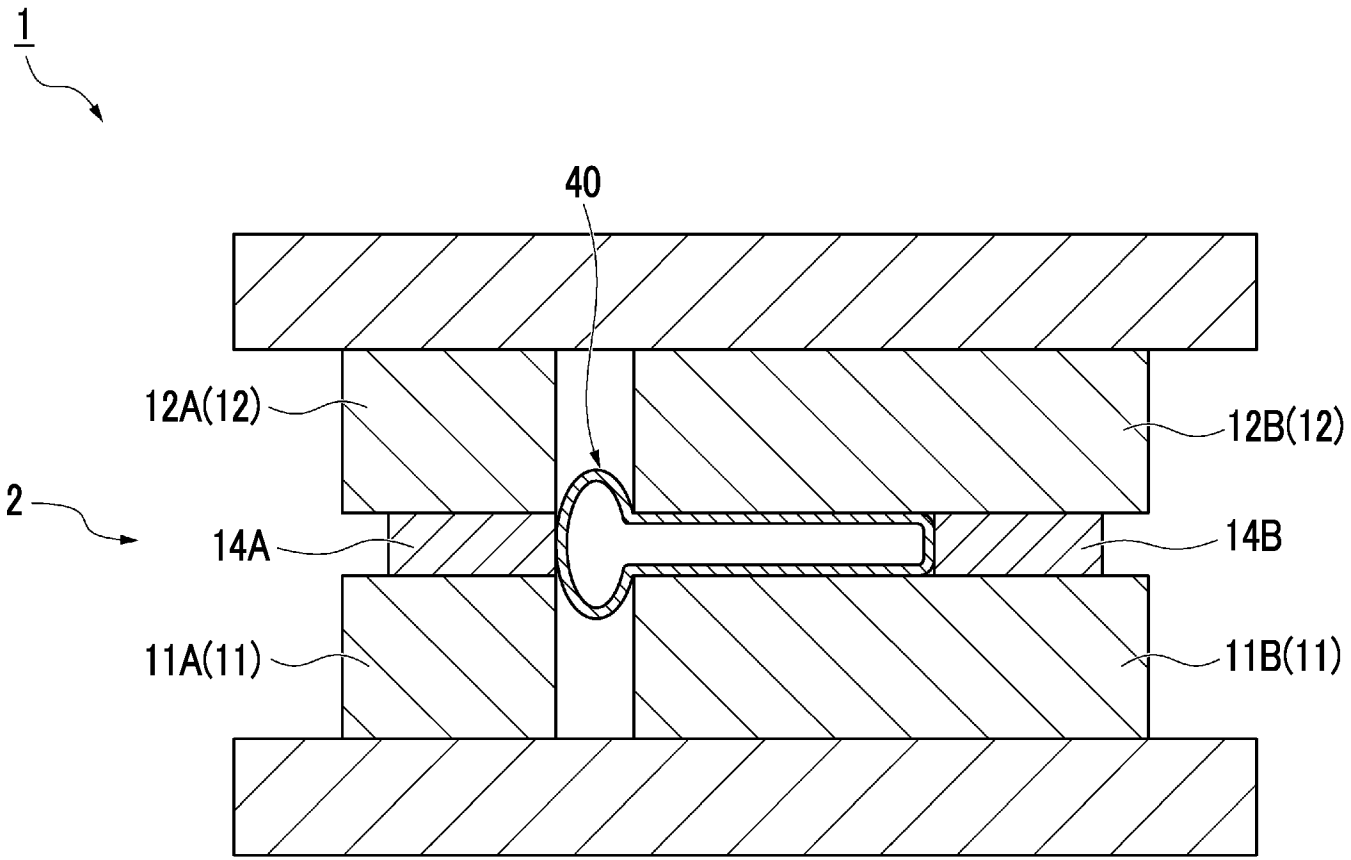
FIG. 14 is a cross-sectional view showing a state of forming by the forming tool.

For example, the forming device 1 as shown in FIGS. 8 to 11 may be adopted. In addition, the metal pipe 41 shown in FIG. 11 may be formed thereby. Specifically, in the forming device 1 shown in FIGS. 8 to 11, the first portion 11A and the second portion 11B in the lower die 11 and the first portion 12A and the second portion 12B in the upper die 12 form the flange portions 41*b* and 41*c* at positions different from each other in the lateral direction. Accordingly, as shown in FIG. 11, a pair of the flange portions 41*b* and 41*c* are formed at positions different from each other in the longitudinal direction. In this case, it is possible to adjust positions where the strength and the rigidity are increased with the flange portions 41*b* and 41*c* in the lateral direction (longitudinal direction) on one side and the other side in the vertical direction (transverse direction) of the pipe portion 41*a*. In addition, it is also possible to control a deformation behavior of the metal pipe depending on a direction of a load applied to the metal pipe.

As shown in FIGS. 8 to 11, in the lateral direction, the first portion 11A is larger than the second portion 11B. Therefore, as shown in FIG. 11, the lower flange portion 41*b* is formed at a position closer to the die 14B side in the lateral direction (longitudinal direction) with respect to the pipe portion 41*a*. The upper flange portion 41*c* is formed at a position closer to the die 14A side in the lateral direction (longitudinal direction) with respect to the pipe portion 41*a*. The operation of the forming device 1 in FIGS. 8 to 11 is the same as the operation in FIGS. 4 to 7.

In addition, the forming device 1 as shown in FIGS. 12 to 15 may be adopted. In addition, the metal pipe 41 shown in FIG. 15 may be formed thereby. Specifically, in the forming device 1 shown in FIGS. 12 to 15, the first portions 11A and 12A and the second portions 11B and 12B may form the flange portions 41*b* and 41*c* at the same position as one side surface 41*d* in the lateral direction (longitudinal direction) of the metal pipe 41 (refer to FIG. 15). In this case, it is also possible to control a deformation behavior of the metal pipe depending on a direction of a load applied to the metal pipe in a case where there is a shape limitation such that a position of the flange portion is only at an end in terms of position. In addition, the same stress is generated for a load from a target direction (a load such as a bending load), and the shape can be balanced in terms of strength.

Figure 15:
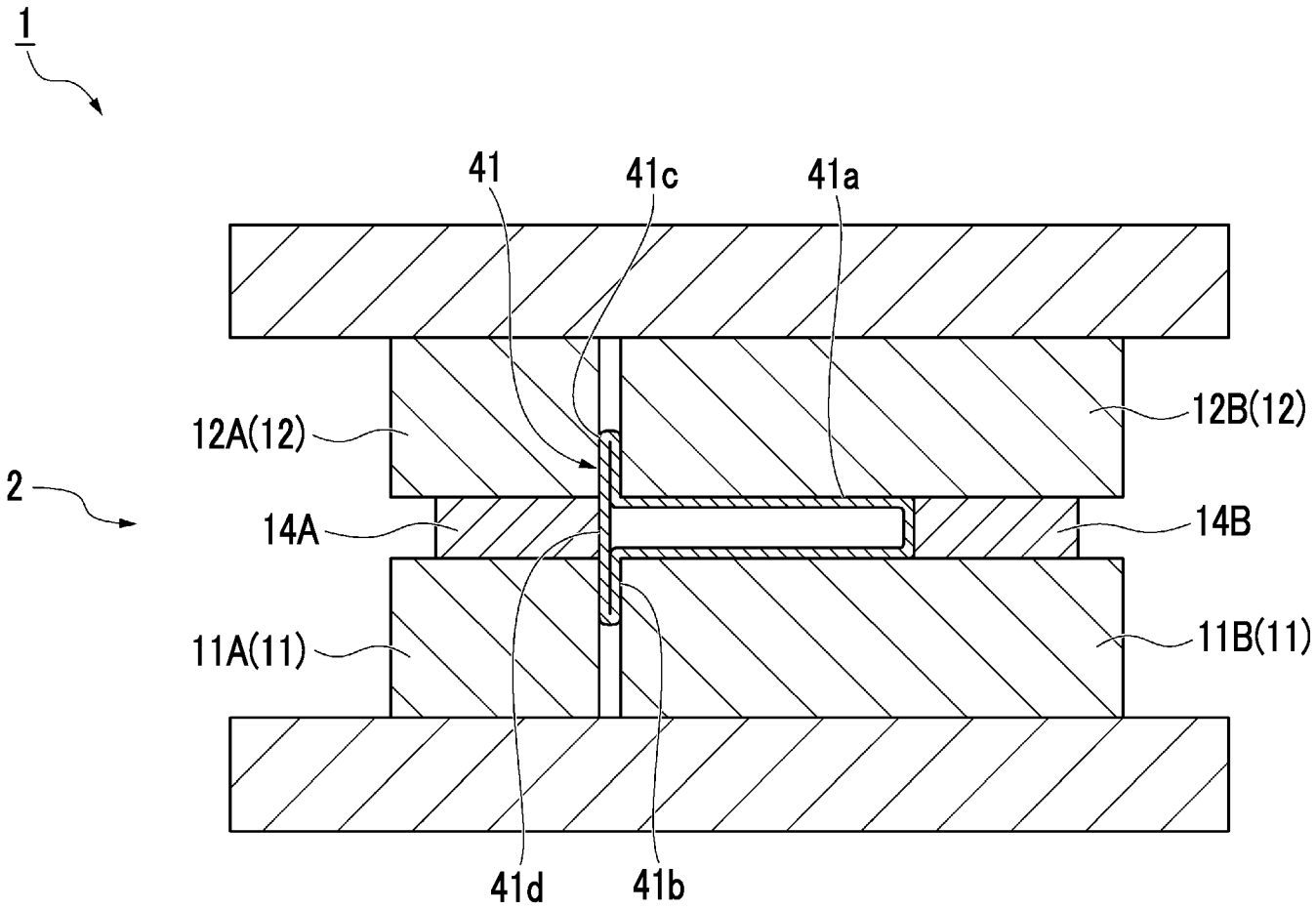
FIG. 15 is a cross-sectional view showing a state of forming by the forming tool.
Figure 16:
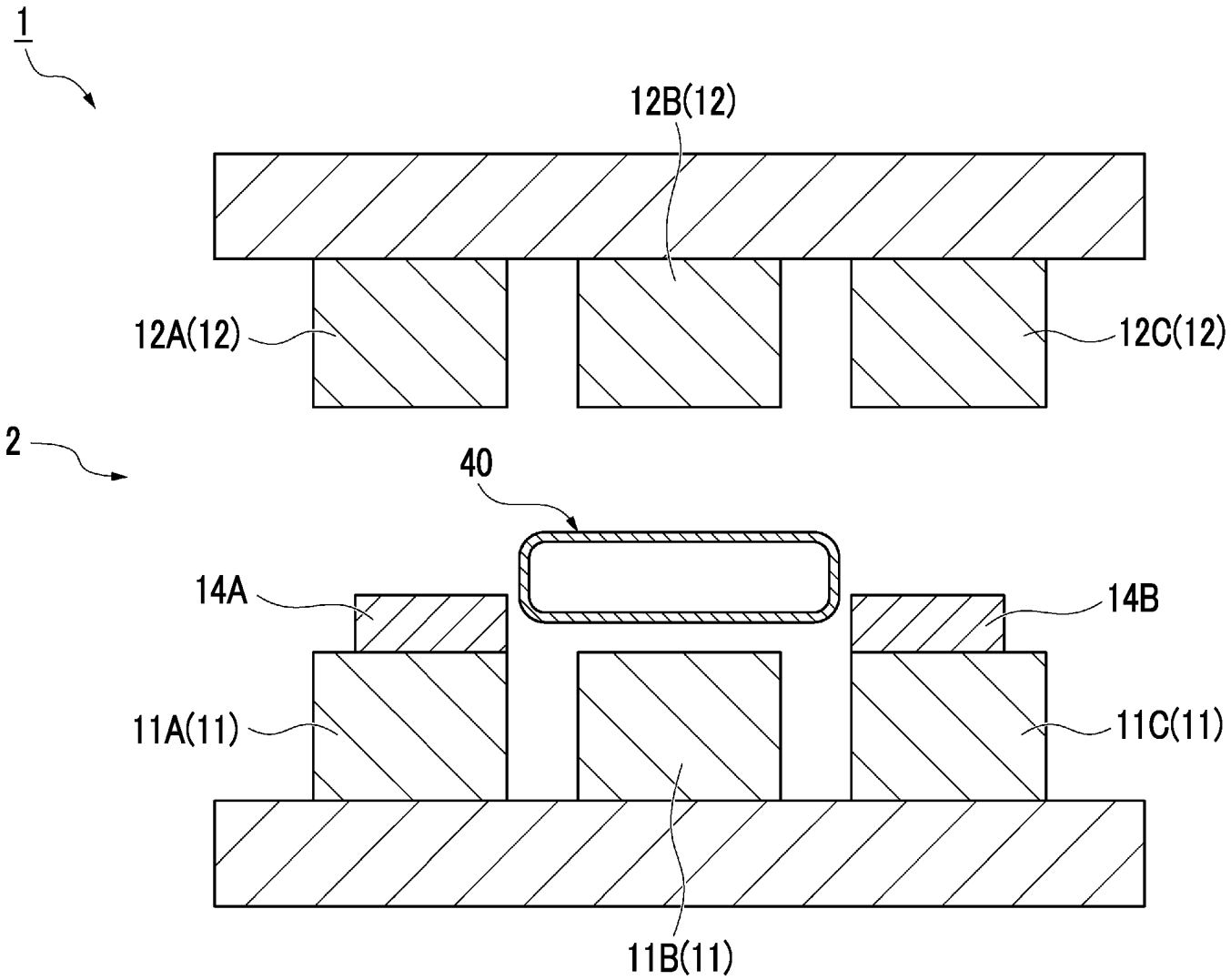
FIG. 16 is a cross-sectional view showing a state of forming by the forming tool.
Figure 17:
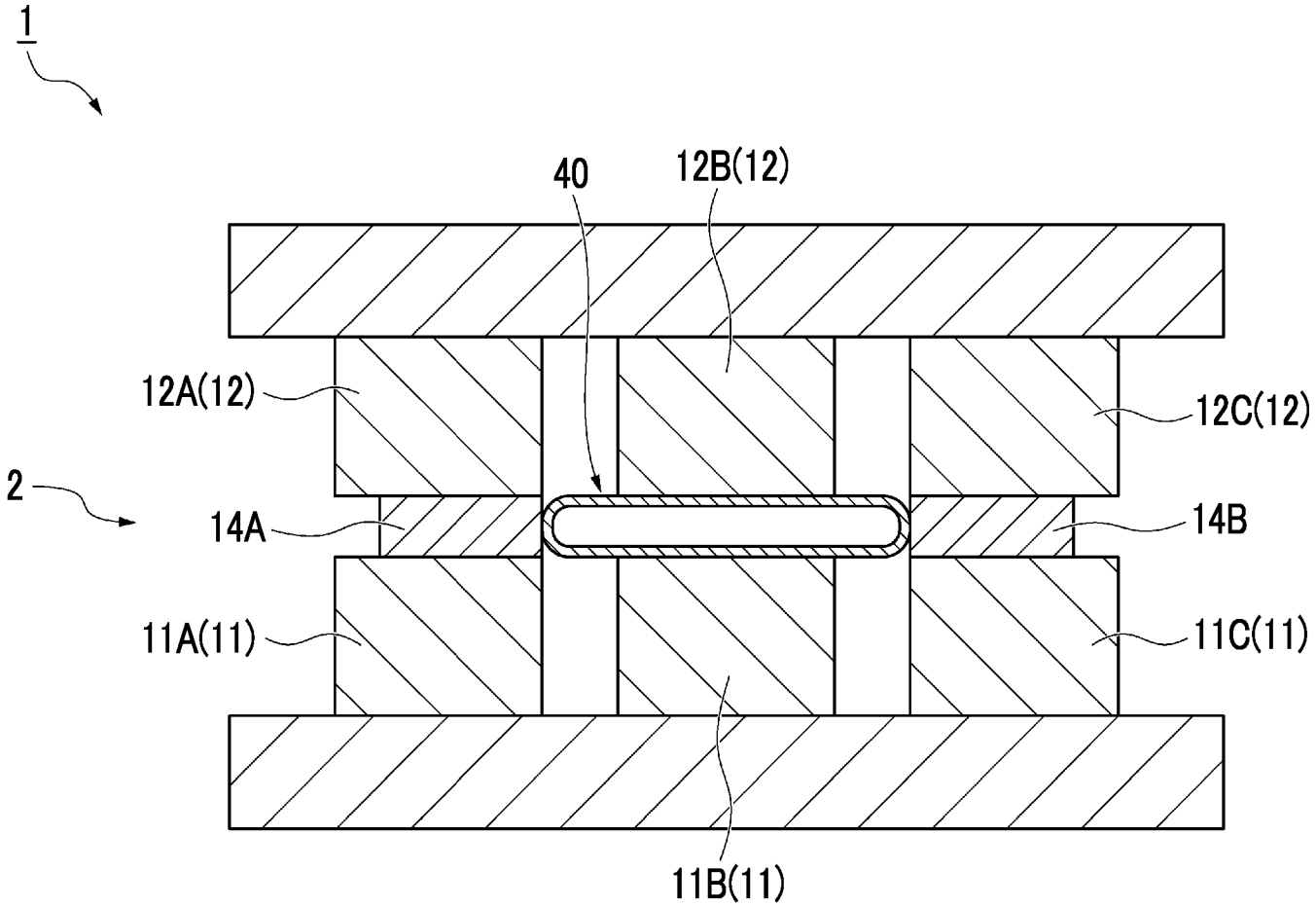
FIG. 17 is a cross-sectional view showing a state of forming by the forming tool.
Figure 18:
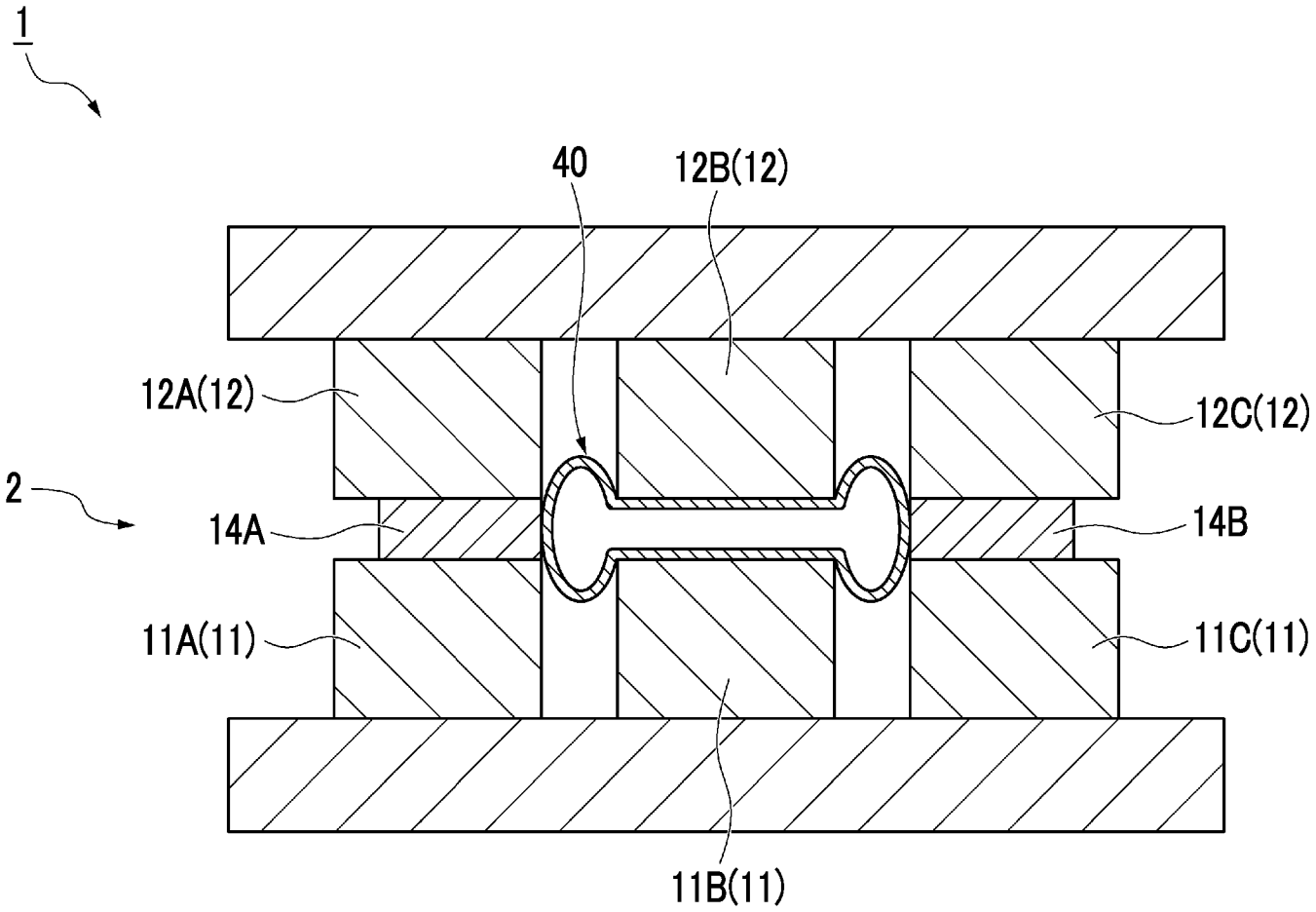
FIG. 18 is a cross-sectional view showing a state of forming by the forming tool.

As shown in FIGS. 12 to 15, in the lateral direction, the first portions 11A and 12A are smaller than the second portions 11B and 12B. Therefore, as shown in FIG. 15, the flange portions 41*b* and 41*c* on both sides are formed at positions closer to the die 14A side in the lateral direction (longitudinal direction) with respect to the pipe portion 41*a*. Then, the flange portions 41*b* and 41*c* protrude in the vertical direction such that one side surface 41*d* in the lateral direction (longitudinal direction) of the pipe portion 41*a* extends in the vertical direction (transverse direction) as it is. The operation of the forming device 1 in FIGS. 12 to 15 is the same as the operation in FIGS. 4 to 7. The die 14A may be integrally formed with the upper die 12A, or conversely, the die 14A may be integrally formed with the lower die 11A.

Figure 19:
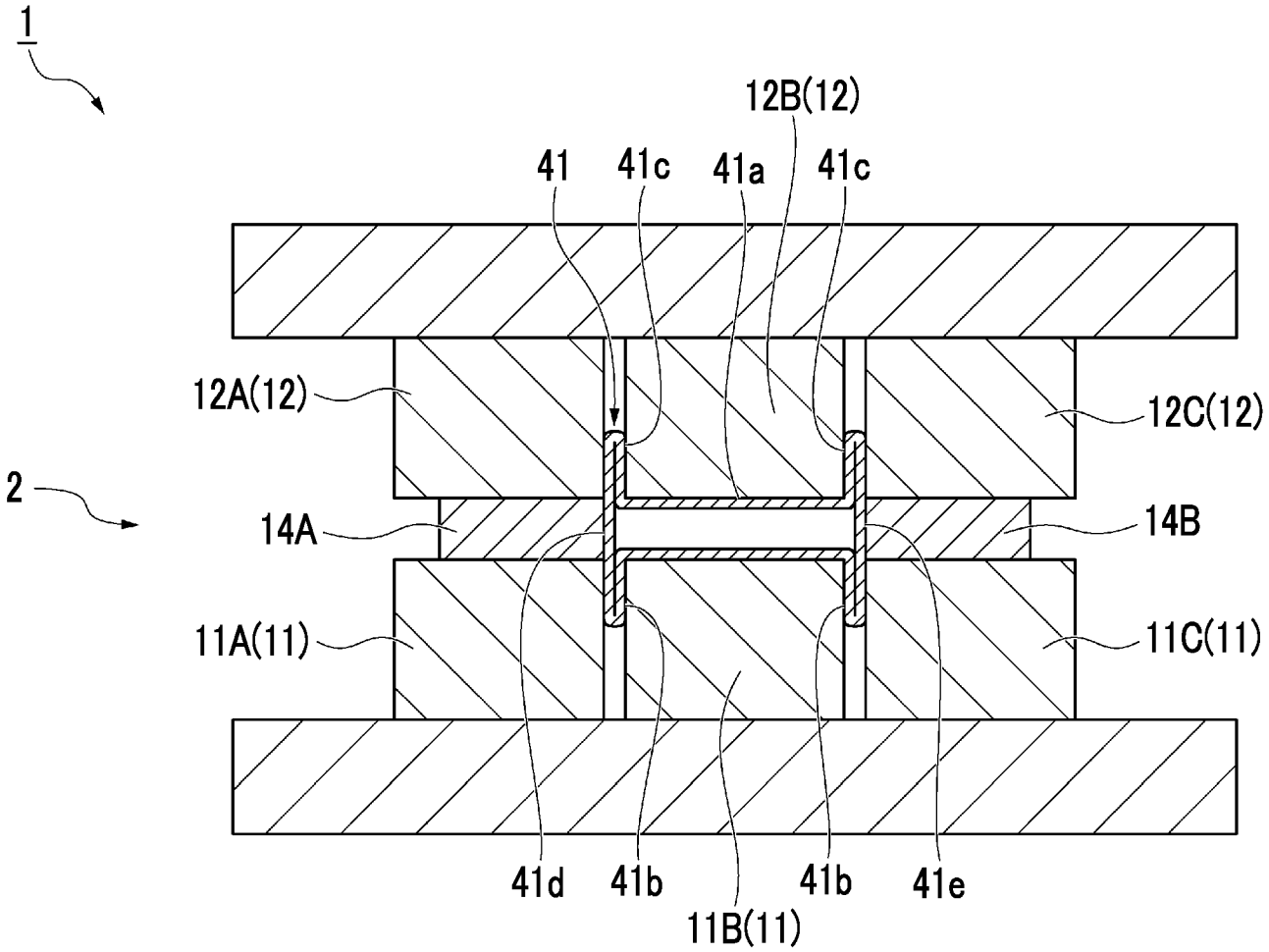
FIG. 19 is a cross-sectional view showing a state of forming by the forming tool.

In addition, the forming device 1 as shown in FIGS. 16 to 19 may be adopted. In addition, the metal pipe 41 shown in FIG. 19 may be formed thereby. Specifically, in the forming device 1 shown in FIGS. 16 to 19, the lower die 11 and the upper die 12 may include third portions 11C and 12C that form another flange portions 41*b* and 41*c* by sandwiching another part of the metal pipe material 40 with the second portions 11B and 12B. In this case, as shown in FIG. 19, in the pipe portion 41*a*, a plurality of (here, two each) flange portions 41*b* and 41*c* protruding to both sides in the vertical direction (transverse direction) may be formed at positions different from each other in the lateral direction (longitudinal direction). In this case, the number of the flange portions 41*b* and 41*c* can be increased to increase the strength and the rigidity.

As shown in FIGS. 16 to 19, in the lateral direction, the lower die 11 is divided into three parts, and the upper die 12 is divided into three parts. The first portions 11A and 12A are smaller than the second portions 11B and 12B. Therefore, as shown in FIG. 19, the flange portions 41*b* and 41*c* relating to one set are formed at positions closer to the die 14A side in the lateral direction (longitudinal direction) with respect to the pipe portion 41*a*. Then, the flange portions 41*b* and 41*c* relating to one set protrude in the vertical direction such that one side surface 41*d* in the lateral direction (longitudinal direction) of the pipe portion 41*a* extends in the vertical direction (transverse direction) as it is. Further, the flange portions 41*b* and 41*c* relating to the other set are formed at positions closer to the die 14B side in the lateral direction (longitudinal direction) with respect to the pipe portion 41*a*. Then, the flange portions 41*b* and 41*c* relating to the other set protrude in the vertical direction such that the other side surface 41*e* in the lateral direction (longitudinal direction) of the pipe portion 41*a* extends in the vertical direction (transverse direction) as it is. The operation of the forming device 1 in FIGS. 16 to 19 is the same as the operation in FIGS. 4 to 7. The dies 14A and 14B may be integrally formed with the upper dies 12A and 12C, or conversely, the dies 14A and 14B may be integrally formed with the lower dies 11A and 11C.

Figure 23:
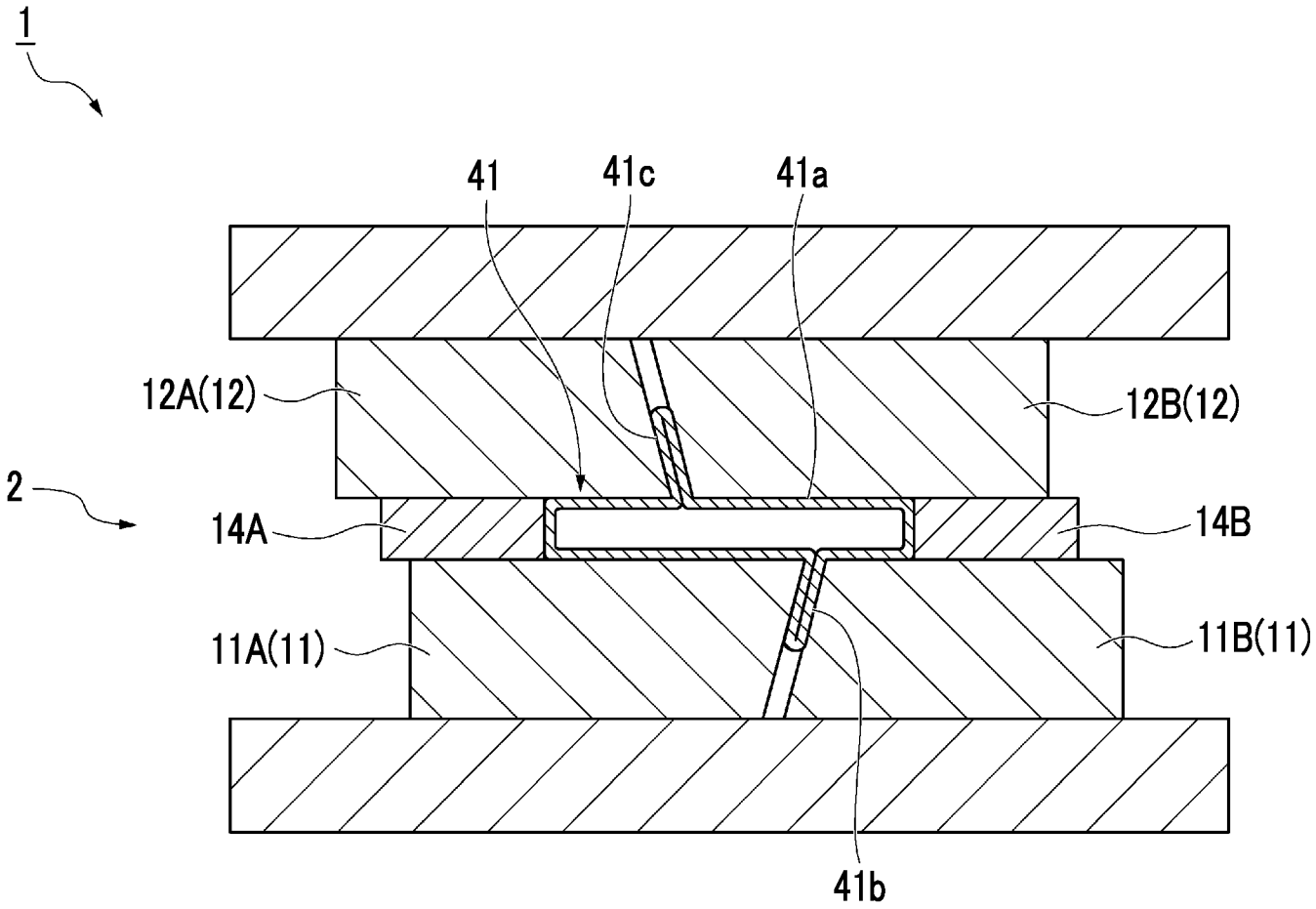
FIG. 23 is a cross-sectional view showing a state of forming by the forming tool.

In addition, the forming device 1 as shown in FIGS. 20 to 23 may be adopted. In addition, the metal pipe 41 shown in FIG. 23 may be formed thereby. Specifically, in the forming device 1 shown in FIGS. 20 to 23, the first portions 11A and 12A and the second portions 11B and 12B form the flange portions 41*b* and 41*c* that are inclined with respect to the vertical direction. In this case, as shown in FIG. 23, the flange portions 41*b* and 41*c* protrude so as to be inclined with respect to the transverse direction. In this case, the rigidity can be increased, and a deformation behavior of a formed body depending on a direction of a load applied to the metal pipe can be controlled in a more preferable direction. Further, even if the rigidity and the strength are inferior to those in a case where the flange portions are in the vertical direction, there is a case where it is more convenient to have a certain inclination angle in joining with ancillary parts, and it is possible to meet design requirements. In addition, there is a possibility that the deformation behavior can be optimized depending on the direction of the load and the inclination of the flange portion.

Figure 20:
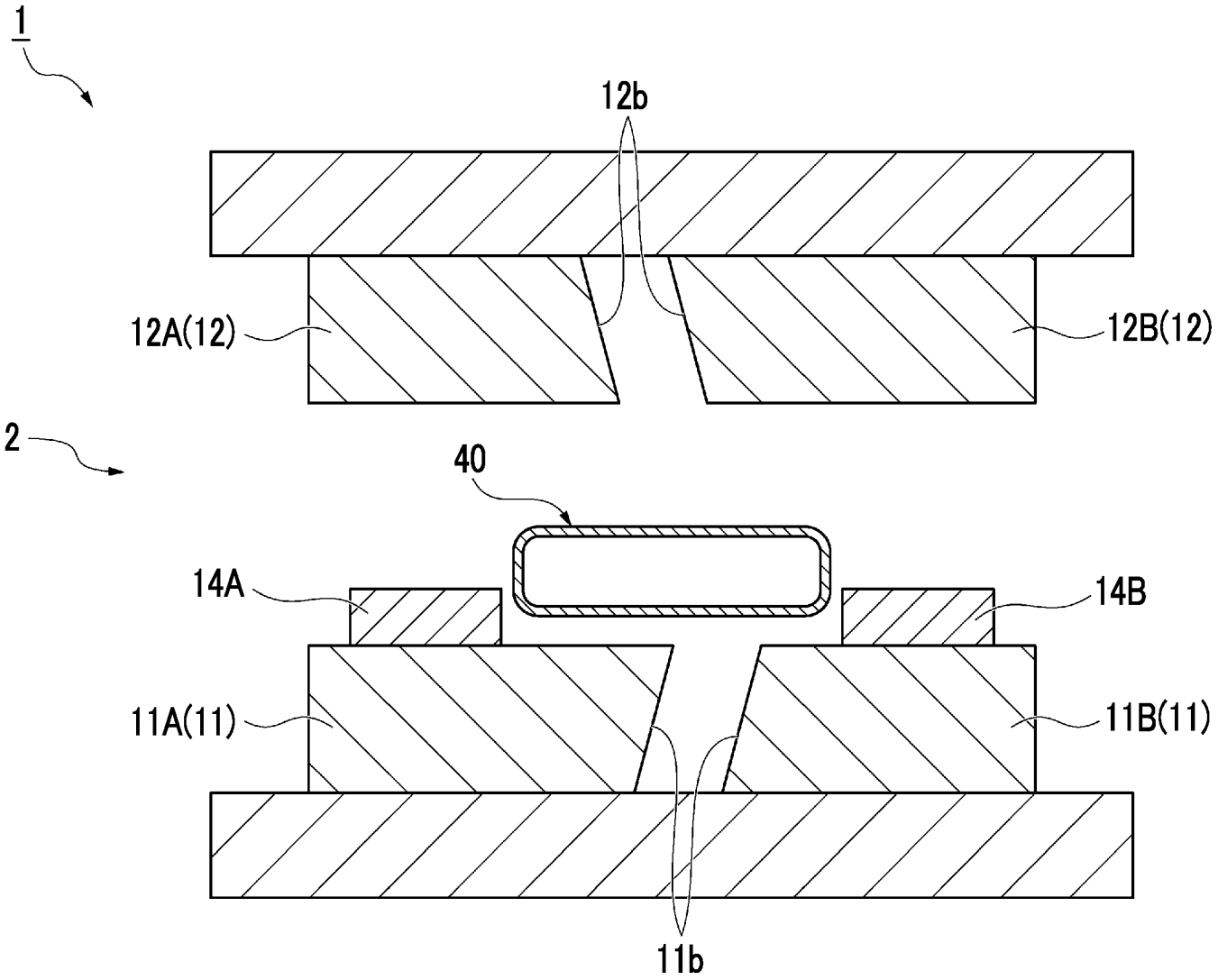
FIG. 20 is a cross-sectional view showing a state of forming by the forming tool.
Figure 21:
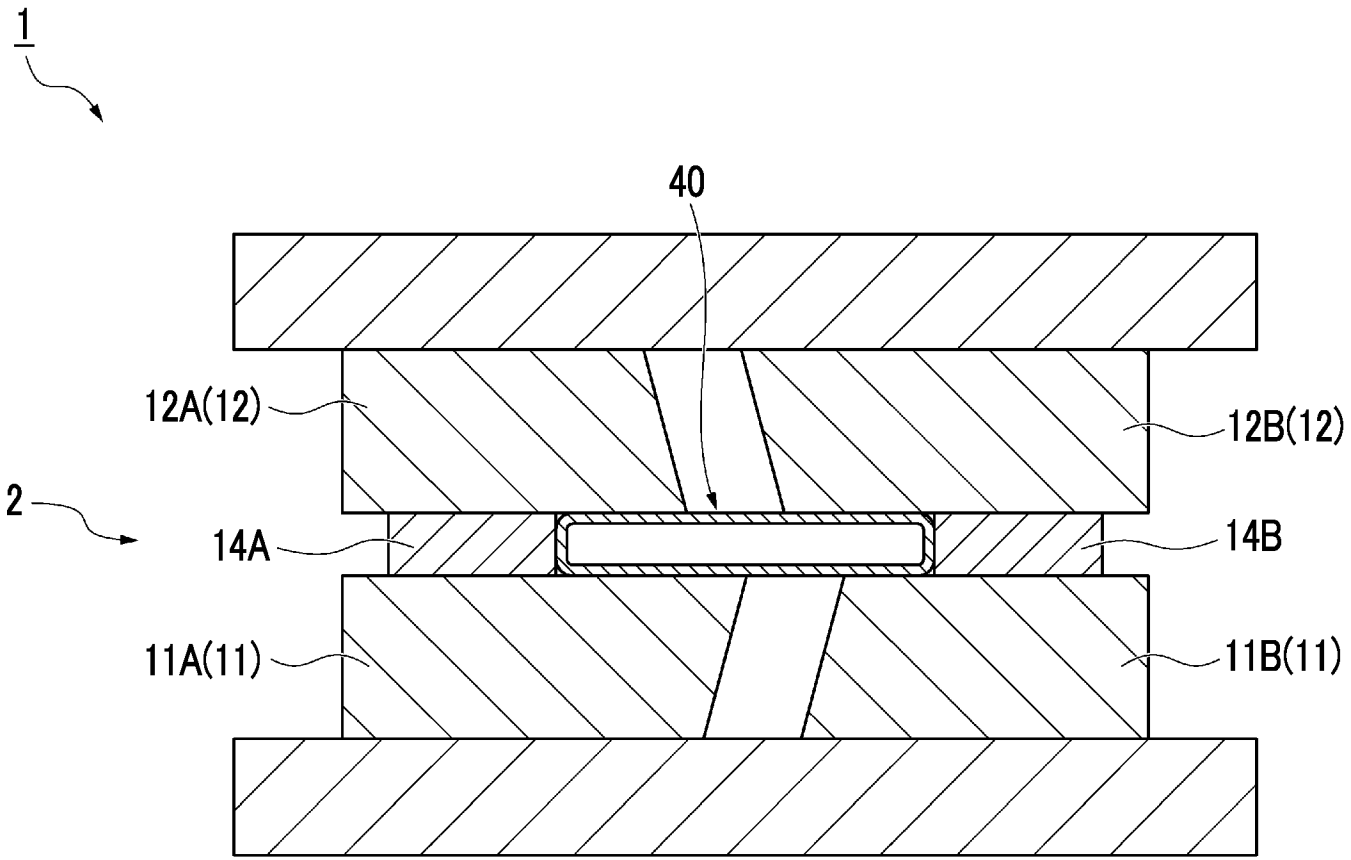
FIG. 21 is a cross-sectional view showing a state of forming by the forming tool.
Figure 22:
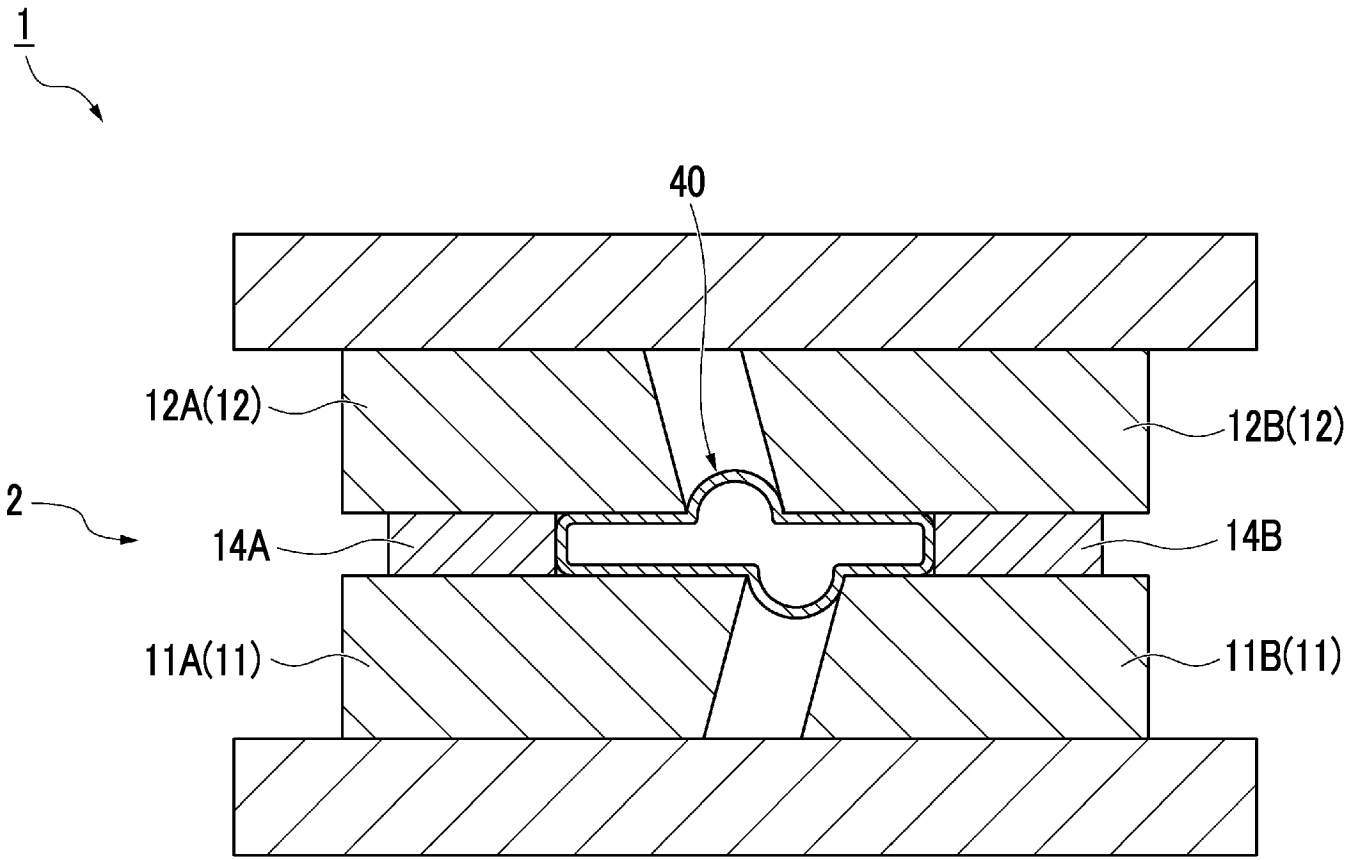
FIG. 22 is a cross-sectional view showing a state of forming by the forming tool.

As shown in FIG. 20, the flange portion forming surfaces 11*b* of the first portion 11A and the second portion 11B extend in a state of being inclined with respect to the vertical direction. In addition, the flange portion forming surfaces 12*b* of the first portion 12A and the second portion 12B extend in a state of being inclined with respect to the vertical direction. Therefore, as shown in FIG. 23, the flange portions 41*b* and 41*c* on both sides protrude so as to be inclined with respect to upper and lower side surfaces of the pipe portion 41*a*. The operation of the forming device 1 in FIGS. 20 to 23 is the same as the operation in FIGS. 4 to 7.

In the above-described embodiment, the description has been made by using the die adopted in the forming device for STAF as an example. However, the type of the forming device in which the die according to the embodiment of the present invention is adopted is not particularly limited, and may be any type of the forming device that supplies a fluid to expand the metal pipe material.

A facing direction between the first die and the second die does not have to be the vertical direction and may be the horizontal direction.

In addition, the configuration of the forming device shown in each drawing is merely an example, and may be appropriately changed without departing from the concept of the invention of the present application. For example, an operation timing and a contact state of each die may be appropriately changed. For example, in the above-described example, the dies 14A and 14B are in contact with the dies 11 and 12 so as to be sandwiched therebetween in a completely closed state, but in the meantime, the dies 14A and 14B may be in any contact state with respect to the dies 11 and 12.

It should be understood that the invention is not limited to the above-described embodiment, but may be modified into various forms on the basis of the spirit of the invention. Additionally, the modifications are included in the scope of the invention.

What is claimed is:

1. A forming device that forms a metal pipe with at least one flange portion, the forming device comprising:

a forming tool that forms the metal pipe, wherein the forming tool includes a first die and a second die facing each other in a first direction in a cross-sectional view, and a third die disposed on at least one side of a metal pipe material in a second direction intersecting the first direction, at least one of the first die and the second die is divided in the second direction and sandwiches a part of the metal pipe material in the second direction to form the at least one flange portion, at least one of the first die and the second die includes a first portion and a second portion which sandwich the part of the metal pipe material in the second direction to form the at least one flange portion, and the first portion and the second portion are configured to move in the second direction to form the at least one flange portion.

2. The forming device according to claim 1, wherein both the first die and the second die have the first portion and the second portion.

3. The forming device according to claim 2, wherein the at least one flange portion is two flange portions, and the first portion and the second portion in the first die, and the first portion and the second portion in the second die form the two flange portions at positions different from each other in the second direction.

4. The forming device according to claim 1, wherein the first portion and the second portion form the at least one flange portion at a same position as one side surface in the second direction of the metal pipe material.

5. The forming device according to claim 1, wherein at least one of the first die and the second die includes a third portion that sandwiches another part of the metal pipe material with the second portion to form another flange portion.

6. The forming device according to claim 1, wherein the first portion and the second portion form the at least one flange portion inclined with respect to the first direction.

7. The forming device according to claim 1, further comprising:

a holding unit that holds the metal pipe material disposed between the first die and the second die, wherein the holding unit includes a first lower electrode and a first upper electrode that hold the metal pipe material on one end side in an extending direction of the forming tool, and a second lower electrode and a second upper electrode that hold the metal pipe material on the other end side in the extending direction of the forming tool.

8. The forming device according to claim 7, wherein groove portions having a shape corresponding to an outer peripheral surface of the metal pipe material are formed on an upper surface of the first lower electrode, a lower surface of the first upper electrode, an upper surface of the second lower electrode, and a lower surface of the second upper electrode.

9. The forming device according to claim 1, further comprising:

a heating unit that heats the metal pipe material by energizing the metal pipe material, wherein the heating unit heats the metal pipe material in a state in which the metal pipe material is spaced apart from the first die and the second die between the first die and the second die.

10. The forming device according to claim 1, further comprising:

a fluid supply unit that supplies a high-pressure fluid into the metal pipe material held between the first die and the second die, wherein the fluid supply unit includes a nozzle and a drive mechanism that moves the nozzle forward and backward with respect to an opening portion of the metal pipe material, and the drive mechanism brings the nozzle into close contact with an end portion of the metal pipe material at a time of supply of the fluid.

* * * * *